US007765749B2

(12) United States Patent
Palidis

(10) Patent No.: US 7,765,749 B2
(45) Date of Patent: Aug. 3, 2010

(54) FAST MOVING DRILLING RIG

(75) Inventor: Anastasios Palidis, Katy, TX (US)

(73) Assignee: National Oilwell, L.P., Houston, TX (US)

( * ) Notice: Subject to any disclaimer, the term of this patent is extended or adjusted under 35 U.S.C. 154(b) by 1870 days.

(21) Appl. No.: 10/827,956

(22) Filed: Apr. 20, 2004

(65) Prior Publication Data

US 2004/0211598 A1 Oct. 28, 2004

Related U.S. Application Data

(60) Provisional application No. 60/466,029, filed on Apr. 25, 2003.

(51) Int. Cl.
*E21B 7/00* (2006.01)

(52) U.S. Cl. ..... 52/112; 52/119; 52/7; 173/186; 173/28; 173/184

(58) Field of Classification Search ..... 52/112, 52/119, 7; 175/162; 173/186, 28, 184; 254/90, 254/91, 93 L; 82/62.5
See application file for complete search history.

(56) References Cited

U.S. PATENT DOCUMENTS

| | | | | |
|---|---|---|---|---|
| 2,594,847 A | | 4/1952 | Bates et al. | 255/19 |
| 3,145,786 A | | 8/1964 | O'Neill et al. | 175/85 |
| 3,228,151 A | * | 1/1966 | Woolslayer et al. | 52/64 |
| 3,365,008 A | | 1/1968 | Zimmerman et al. | 175/85 |
| 3,807,109 A | * | 4/1974 | Jenkins et al. | 52/120 |
| 3,922,825 A | | 12/1975 | Eddy et al. | 52/116 |
| 3,942,593 A | | 3/1976 | Reeve, Jr. et al. | 173/23 |
| 3,983,946 A | | 10/1976 | Pereau | 173/1 |
| 3,994,350 A | | 11/1976 | Smith et al. | 175/85 |
| 4,078,617 A | | 3/1978 | Cherrington | 173/1 |
| 4,138,805 A | | 2/1979 | Patterson | 52/118 |
| 4,366,650 A | * | 1/1983 | Patterson | 52/118 |

(Continued)

FOREIGN PATENT DOCUMENTS

CA 1 169 627 6/1984

(Continued)

OTHER PUBLICATIONS

*H&P FlexRig*, 2003, pp. 1-3, www.hpidc.com/images/flexsotxmovtimegif.gif.

(Continued)

*Primary Examiner*—Richard E Chilcot, Jr.
*Assistant Examiner*—Mark R Wendell
(74) *Attorney, Agent, or Firm*—Howrey LLP

(57) ABSTRACT

A method and apparatus for transporting and assembling a drilling rig is disclosed. The drilling rig of a preferred embodiment of the present invention utilizes specialized positioning pads integral to the side boxes of the drilling rig to facilitate the connection of the center drill floor of the drilling rig to the side boxes of the rig. A preferred embodiment of the present invention may also utilize a specialized positioning dolly and an adjustable fifth-wheel truck connection for transporting the mast to the drill site, assembling the mast sections together, and positioning the mast for connection to the drill floor of the rig. The result is a unique drilling rig design and sequence for assembly that significantly reduces the time required to transport the rig from location to location and to assemble the rig at the drill site.

26 Claims, 20 Drawing Sheets

U.S. PATENT DOCUMENTS

| | | | | | |
|---|---|---|---|---|---|
| 4,368,602 | A | | 1/1983 | Manten | 52/115 |
| 4,371,041 | A | | 2/1983 | Becker et al. | 173/28 |
| 4,444,536 | A | | 4/1984 | Brown | 414/22 |
| 4,489,526 | A | | 12/1984 | Cummins | 52/120 |
| 4,744,710 | A | | 5/1988 | Reed | 414/22 |
| 4,753,300 | A | | 6/1988 | Shaw et al. | 173/164 |
| 4,821,814 | A | | 4/1989 | Willis et al. | 173/164 |
| 4,831,795 | A | * | 5/1989 | Sorokan | 52/120 |
| 4,899,832 | A | | 2/1990 | Bierscheid, Jr. | 173/23 |
| 5,107,940 | A | | 4/1992 | Berry | 175/85 |
| 5,152,109 | A | * | 10/1992 | Boers | 52/143 |
| 5,381,867 | A | | 1/1995 | Berry | 175/85 |
| 5,593,250 | A | | 1/1997 | Smith et al. | 405/205 |
| 5,657,823 | A | | 8/1997 | Kogure et al. | 166/340 |
| 5,755,296 | A | | 5/1998 | Richardson et al. | 175/162 |
| 5,794,723 | A | | 8/1998 | Caneer, Jr. et al. | 175/85 |
| 6,024,181 | A | | 2/2000 | Richardson et al. | 175/162 |
| 6,030,148 | A | | 2/2000 | Törmälä et al. | 405/196 |
| 6,176,495 | B1 | * | 1/2001 | Decker | 280/6.153 |
| 6,257,349 | B1 | | 7/2001 | Bardwell | 173/28 |
| 6,533,045 | B1 | | 3/2003 | Cooper | 173/28 |
| 6,634,436 | B1 | | 10/2003 | Desai | 173/1 |
| 6,848,515 | B2 | | 2/2005 | Orr et al. | 173/1 |
| 6,860,337 | B1 | | 3/2005 | Orr et al. | 173/28 |

FOREIGN PATENT DOCUMENTS

| | | |
|---|---|---|
| EP | 1 176 283 A2 | 1/2002 |
| WO | WO 00/11306 | 3/2000 |

OTHER PUBLICATIONS

*FlexRig*, 2003, pp. 1-3, www.hpidc.com/operations/dril_flex._what.html.

*US Land Drilling*,,2003, pp. 1-2, www.hpidc.com/operations/dril_land.html.

PCT/USO4/12388 International Search Report and Written Opinion.

* cited by examiner

FAST MOVING DRILLING RIG

This application claims the benefit of U.S. Provisional Application No. 60/466,029, filed Apr. 25, 2003.

FIELD OF THE INVENTION

The present invention relates to a transportable drilling rig particularly useful in the oil and gas industry. In particular, the invention relates to an improved drilling rig design that allows the drilling rig to be transported from location to location and assembled for operation in substantially less time than prior art drilling rigs.

BACKGROUND OF THE INVENTION

In most land-based drilling operations, such as when drilling for oil and gas on land, it is necessary to transport a drilling rig to the site where the drilling operations will take place. Typically, these drilling rigs are very large and, thus, must be transported to the drilling site in several pieces. These rigs are typically transported in pieces that comprise the three main sections of a drilling rig: the substructure, the equipment floor (or drill floor), and the mast. Depending on the size of the drilling rig, the substructure, the equipment floor, and the mast may each be further broken down into multiple pieces for ease of transportation.

The drill floor of the drilling rig is comprised of several segments, all of which, when assembled together, provide the platform or the "floor" for the drilling equipment and the mast that will be used in the drilling operations. It has become the custom to use a drill floor that is elevated above ground level in order to provide clearance for relatively tall blow-out prevention apparatus and other well head equipment used in drilling oil and gas wells. One embodiment of such an elevated-floor drilling rig structure is disclosed in U.S. Pat. No. 4,831,795 to Sorokan.

If an elevated drill floor is used, the drill floor is often connected to a collapsible elevating frame that, when assembled, can be raised—thereby raising the drill floor above the ground. The collapsible elevating frame is part of the substructure and is typically connected to "base side boxes" that form the base upon which the drilling rig stands and to "drill floor side boxes" that form a part of the drill floor.

Once the pieces of the drilling rig reach the site, the complete drilling rig must be reassembled so that drilling operations can commence. Assembling the drilling rig components on site, however, has proven to be a relatively complex and time-consuming process. In many of the prior art drilling rig structures, the drill floor, the substructure, and the mast must be constructed and connected together in, essentially, a piece-by-piece operation.

Additionally, after assembling the various pieces of the drill floor and the substructure, these large and extremely heavy sections of the drilling rig must be moved into position and aligned for connection. Specifically, to connect the drill floor to the substructure requires the rig personnel to align pin holes in the sides of the drill floor with pin holes in the sides of the substructure. Once aligned properly, the drill floor and the substructure must be "pinned" together. Aligning the pin holes of these large sections of drilling rig is a difficult and time consuming process that typically requires the use of a crane. This process can be extremely difficult if the area upon which the base side boxes rest is not well prepared such that it provides a fairly uniform and level "pad" for the drilling rig to rest on.

Further, to pin these sections together, it is necessary for one person to hold the pin in place while another person drives the pin through the pin holes with a sledge hammer or other device. This process is repeated until all the pins connecting the equipment floor and the substructure are driven in place. Given the fact that the equipment floor and the substructure typically require in excess of twenty (20) pins to connect them together, the process of aligning the pin holes and pinning these components together takes a significant amount of time. Moreover, the process of pinning these components together can be dangerous for the rig personnel performing such task.

Once the substructure of the drilling rig—consisting of the side boxes, the elevating frames, and the drill floor—is assembled and positioned over the well center, there is still a substantial amount of work that must be done to completely assemble the drilling rig. For example, the mast of the rig must be completely assembled, connected in place on the drill floor, and raised to the operational position prior to the drill floor being elevated. As with the substructure, assembling a mast at the drill site and positioning it for connection to the drill floor is a difficult and time consuming task—especially in light of the fact that the drilling rig mast is typically in the range of 100 to 180 feet tall depending on the size of the rig.

Once assembled, the mast must be raised to the operational position. In many prior art drilling rigs, the mast is raised by the drawworks. Use of the drawworks to raise the mast, however, requires that the drawworks is operational. The process of getting the drawworks operational is a complex and time-consuming process that can further delay the assembly of the drilling rig.

After the mast is raised, the entire drill floor must be raised to its elevated position—via the collapsible elevating frames of the substructure—and locked in place. Raising the equipment floor often requires the use of gin pole assemblies. These gin pole assemblies add additional weight to the substructure that must be transported from location to location. The gin pole assemblies also must be assembled and erected before elevating the drill floor. After the rig floor is raised, the gin pole assemblies must be "pinned" to the rig floor to secure the floor in the elevated position. As such, the gin poles must be pinned at the height of the elevated drill floor—a height that is often twenty-five feet or more. Pinning the gin poles to the elevated rig floor is thus time consuming and potentially dangerous to rig personnel.

As indicated from the above discussion, the assembly of prior art drilling rigs is a complex, labor-intensive process that takes a substantial amount of time. In today's oil industry, oil companies are becoming increasingly more reluctant to pay for this "rig up" time. Additionally, oil companies are becoming increasingly more reluctant to pay for the time it takes to transport a drilling rig from one location to another. Thus, it is becoming more and more critical for the operators of drilling rigs to minimize the "down time" associated with transporting and assembling drilling rigs so that the return on the substantial capital expenditure associated with building these rigs can be maximized.

Accordingly, what is needed is a drilling rig that can be transported from location to location and assembled at the drilling site more efficiently than the prior art drilling rigs. It is an object of the present invention to provide a method and apparatus for transporting a drilling rig to a drilling site and assembling it on site in significantly less time than prior art drilling rigs. Those and other objectives will become apparent to those of skill in the art from a review of the specification below.

SUMMARY OF THE INVENTION

A method and apparatus for transporting and assembling a drilling rig is disclosed. The drilling rig of a preferred embodiment of the present invention utilizes specialized positioning pads integral to the side boxes of the drilling rig to facilitate the connection of the center drill floor section of the drilling rig to the side boxes of the rig. A preferred embodiment of the present invention may also utilize a specialized positioning dolly and an adjustable fifth-wheel truck connection for transporting the mast to the drill site, assembling the mast sections together, and positioning the mast for connection to the drill floor of the rig. The result is a unique drilling rig design and sequence for assembly that significantly reduces the time required to transport the rig from location to location and to assemble the rig at the drilling site.

In an alternative embodiment of the present invention, a standard drilling rig substructure without integral positioning pads is connected to the drill floor through use of a unique structural connector. The unique structural connector eliminates the use of pins as in the prior art pin-type connectors and reduces the time required to connect the drill floor to the side boxes of the drilling rig.

Finally, in another embodiment of the present invention, a special guide bar system is used to connect a standard substructure without integral positioning pads to the drill floor of the rig. The unique guide bar system utilizes specifically located mating blocks and guide bars attached to support rails on the side boxes and corresponding mating blocks attached to support rails on the center drill floor section to "guide" the center drill floor section into position for connection to the side boxes. The unique guide bar system eliminates the need for a crane in connecting the center drill floor section to the side boxes and reduces the time required to connect the center drill floor section to the side boxes.

BRIEF DESCRIPTION OF THE DRAWINGS

The following figures form part of the present specification and are included to further demonstrate certain aspects of the present invention. The invention may be better understood by reference to one or more of these figures in combination with the detailed description of specific embodiments presented herein.

DESCRIPTION OF ILLUSTRATIVE EMBODIMENTS

Figure 1:
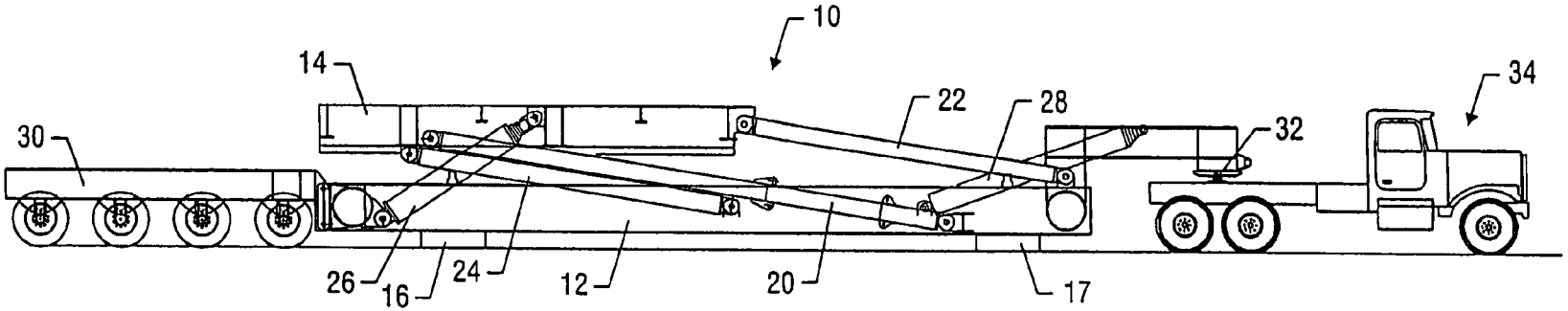
FIG. 1 is a side view of a wheel mounted side box with integral positioning pads according to one embodiment of the present invention.

The following examples are included to demonstrate preferred embodiments of the invention. It should be appreciated by those of skill in the art that the techniques disclosed in the examples which follow represent techniques discovered by the inventor to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the invention.

The unique features of the drilling rig design of the present invention will be understood by reference to the assembly of the rig as disclosed in the following paragraphs. References to like numerals in different figures are intended, as the various components shown in the figures appear in multiple figures. Further, references in the following discussion to the four sides of a drilling rig are based on the location of certain key components of a drilling rig. These components include the V-door, the drawworks, and the "doghouse."

The V-door of a drilling rig is the location where drill pipe is raised from the ground into the mast of the drilling rig. In the following discussion, references to the "V-door side" of the drilling rig is understood to be the right side of the drilling rig while looking at the attached figures.

The drawworks is the unit that spools and unspools the drill line so that drilling operations can be conducted. In the following discussion, references to the "drawworks side" of the drilling rig is understood to be the left side of the drilling rig while looking at the attached figures.

The "doghouse" is the enclosed room where the drilling rig operators monitor and conduct numerous drilling operations. The side of the rig where the "doghouse" is located is referred to as the "driller's side," while the opposite side of the rig is referred to as the "off-driller's side." In the following discussion, references to the "driller's side" of the drilling rig is understood to be the side of the drilling rig located nearest the bottom of the page while looking at the attached top view figures. Conversely, references to the "off-driller's side" of the drilling rig is understood to be the side of the drilling rig located nearest the top of the page while looking at the attached top view figures.

Referring to FIGS. 1 through 14*a*, a unique, wheeled drilling rig structure capable of being quickly moved from location to location and assembled at a drilling site is shown in accordance with one embodiment of the present invention. FIGS. 1-4*a* show the assembly of the drilling rig substructure in a three step sequence. As shown by these figures, the drilling rig substructure of the present invention consists primarily of three separate "loads" that can be wheel mounted and transported by truck to the drilling site. The three loads making up the substructure of the drilling rig consist of two side boxes and the center drill floor section.

Referring to FIG. 1, the off driller's side side box 10 is transported to the well site via a truck 34. The side box 10 comprises the structural components that will provide the support for the rig floor in the elevated position as well as the components that perform the actual raising of the rig floor and the mast of the drilling rig. These components comprise base side box 12, drill floor side box 14, telescoping diagonal brace 20, front leg frame 22, rear leg frame 24, drill floor raising cylinder 26, and mast raising cylinder 28.

The side box 10 is driven in and located such that the center of the well will be lined up with the center of the rotary table when the drilling rig is assembled and raised. The side box 10 of one embodiment of the present invention includes a fifth-wheel connection 32 for connecting to truck 34. Additionally, a wheeled transporter 30 is shown attached to the side box 10 at the opposite end of the side box 10 from the fifth-wheel connection 32 for transport of the side box 10 from location to location. The wheeled transporter 30 is removable from the side box 10 as discussed below. More than one wheeled transporter 30 may be used for transporting the side box 10 depending on the size of the side box 10.

After locating the side box 10 at the well center, positioning pads 16 and 17 "jack down" to support the side box 10. With the side box 10 supported by the positioning pads 16 and 17, the load on the fifth-wheel connection 32 and on the wheeled transporter 30 created by the weight of the side box 10 is removed, at which point the side box 10 can be disconnected from the truck 34 and the wheeled transporter 30. The truck 34 and the wheeled transporter 30 may then be removed from the drill site.

The positioning pads 16 and 17 are integral to the base side box 10. The positioning pads 16 and 17 include horizontal and vertical positioning cylinders that position the side box 10 for connection to the center drill floor section as discussed in more detail with reference to FIGS. 3 and 3*a* below. Although two positioning pads 16 and 17 are shown in this embodiment, one of skill in the art will appreciate that the number of positioning pads that are integral to the base side boxes can vary depending on the size of the side boxes. One positioning pad may be used for smaller side boxes, and more than one positioning pad may be used for larger side boxes.

Figure 1A:
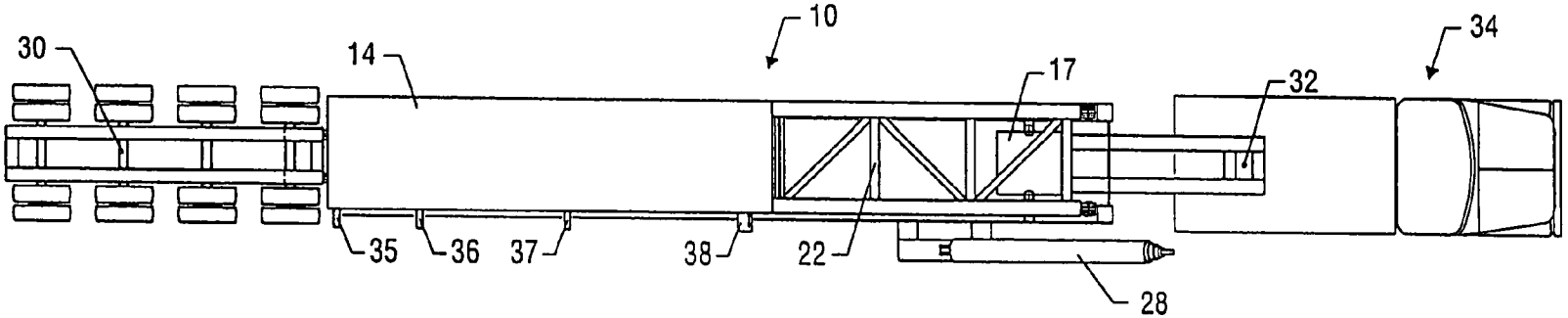
FIG. 1*a* is a top view of the wheel mounted side box shown in FIG. 1.

FIG. 1*a* is a top view showing the side box 10 connected to a truck 34 via the fifth-wheel connection 32 and connected to the wheeled transporter 30 for transport from location to location. FIG. 1*a* also shows four connection points—designated 35, 36, 37, and 38—along the drill floor side box 14. These four connection points provide the locations at which the drill floor side box 14 can be connected to the center drill floor section. One of skill in the art will appreciate that the number of connection points may vary depending on the size of the drilling rig.

Figure 2:
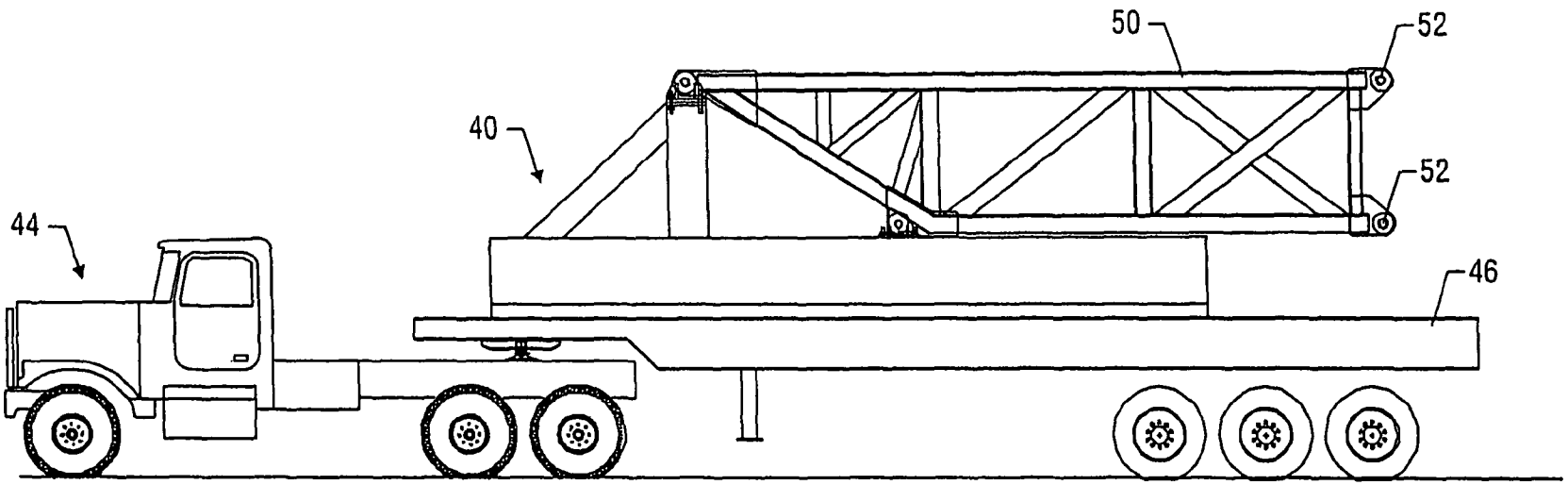
FIG. 2 is a side view of a truck mounted center drill floor section with a bottom mast section connected thereto according to one embodiment of the present invention.

After positioning the side box 10, a trailer mounted center drill floor section 40 is trucked in and positioned in the second step of the rig assembly sequence. FIG. 2 shows the center drill floor section 40 mounted on a trailer 46 that is connected to a truck 44. The center drill floor section 40 in FIG. 2 has mast bottom section 50 attached to it in accordance with one embodiment of the present invention. Mast bottom section 50 includes mast connection lugs 52 for attaching the mast bottom section 50 to the remainder of the mast as discussed in more detail with reference to FIGS. 6-9.

Figure 3:
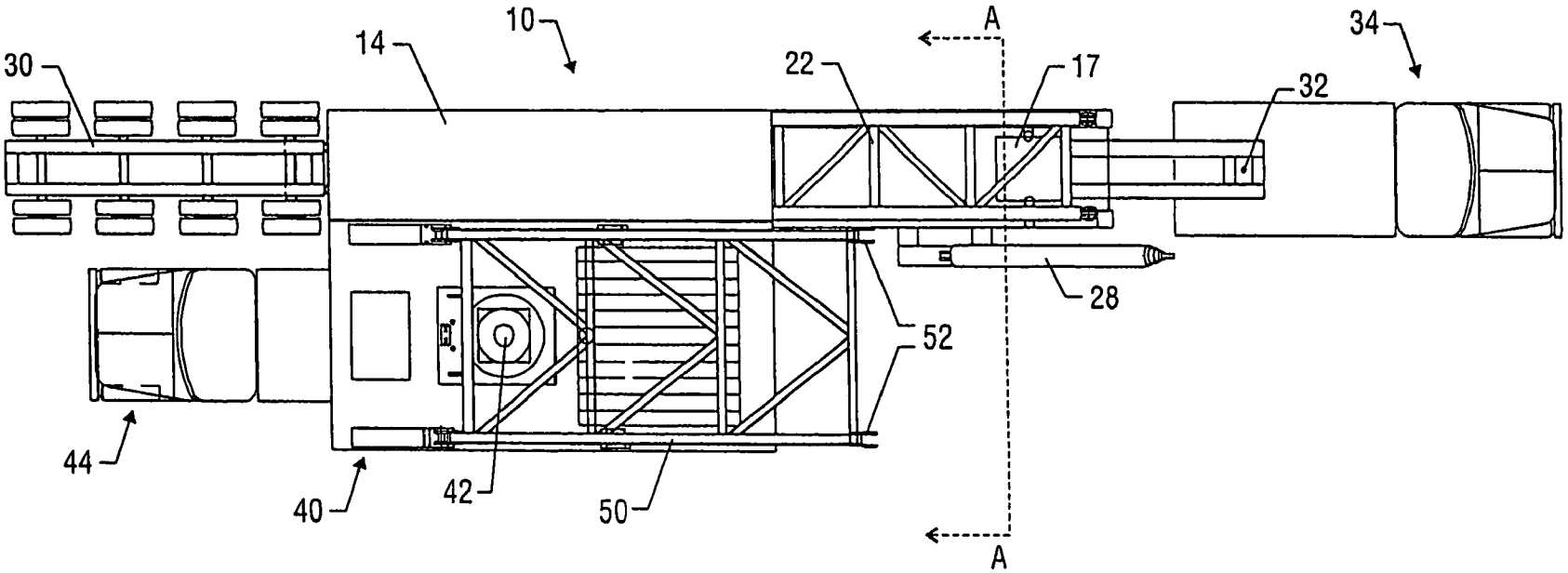
FIG. 3 is a top view of the center drill floor section with a bottom mast section connected thereto (shown in FIG. 2) positioned alongside the off-driller's side side box (shown in FIG. 1) according to one embodiment of the present invention.
Figure 3A:
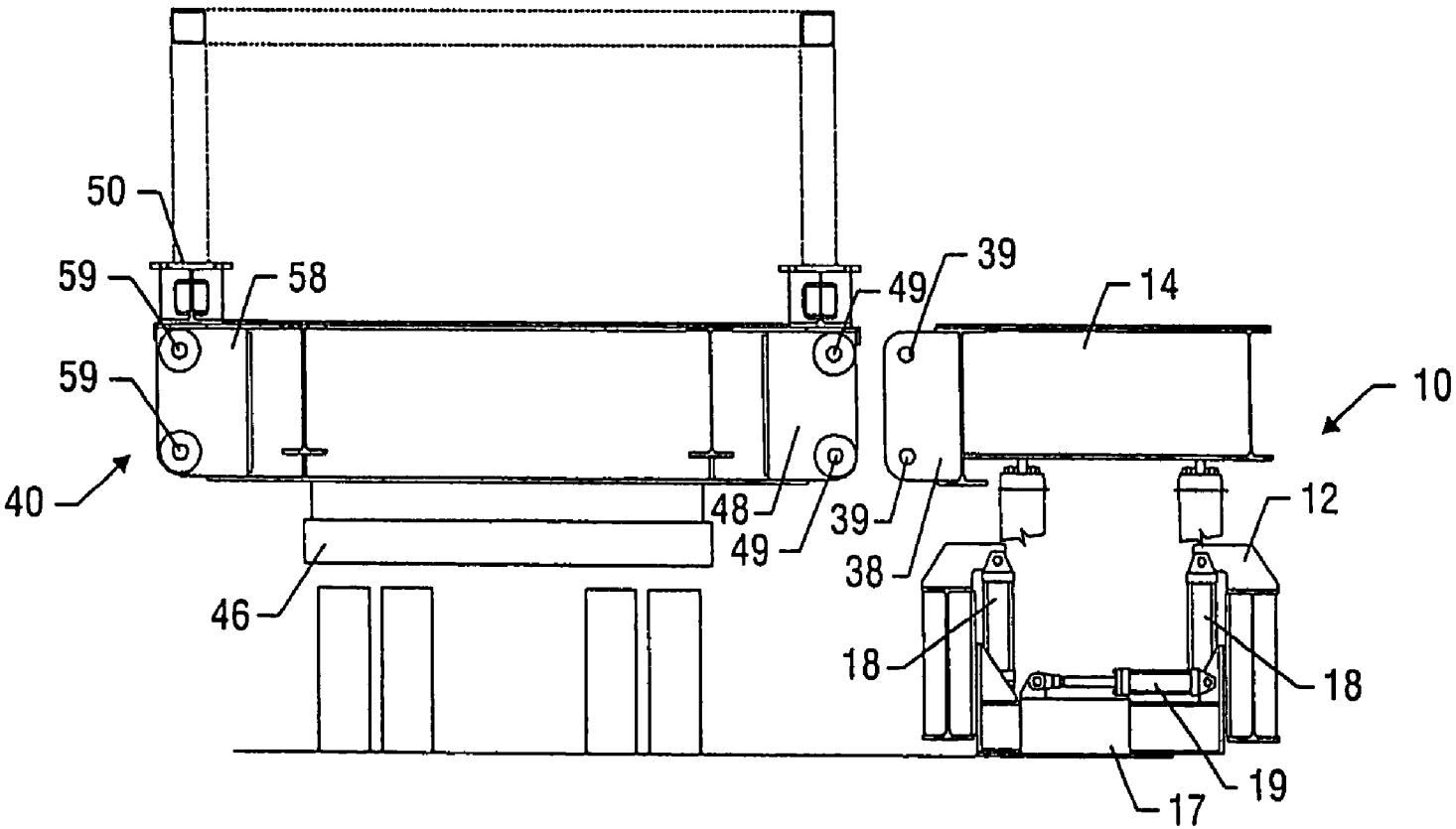
FIG. 3*a* is a front elevation view of the center drill floor section with a bottom mast section connected thereto positioned alongside the side box viewed along the line A-A as shown in FIG. 3.

As shown in FIGS. 3 and 3*a*, the center drill floor section 40 is connected to the drill floor side box 14. The truck 44 and trailer 46 transporting the center drill floor section 40 is backed into position from the drawworks side of the rig towards the V-door side of the rig until mating lug 48 attached to the center drill floor section 40 is lined up with the mating lug 38 attached to the drill floor side box 14. Once mating lug 48 is lined up with mating lug 38 in the front-to-back plane, the positioning pads 16 and 17 are used to "skid" side box 10 sideways and to raise side box 10 until the pin holes 39 in mating lug 38 are aligned with the pin holes 49 in mating lug 48. As shown, positioning pads 16 and 17 utilize three hydraulic positioning cylinders—two vertical positioning cylinders 18 and one horizontal positioning cylinder 19—to move side box 10 in the vertical and horizontal direction. One of skill in the art will appreciate that the number of positioning cylinders can vary depending on the size of the side boxes. For smaller side boxes, only one vertical and one horizontal positioning cylinder may be necessary, while larger side boxes may require multiple horizontal positioning cylinders and multiple vertical positioning cylinders. Additionally, although positioning cylinders for moving the side boxes are disclosed in this embodiment, one of skill in the art will appreciate that alternative means of moving the side boxes can be used in accordance with the objectives of the present invention.

After aligning the pin holes 39 and 49, the center drill floor section 40 can be pinned to the drill floor side box 14 in accordance with one embodiment of the present invention. In a similar fashion, pinned connections between the drill floor side box 14 and the center drill floor section 40 are made at connection points 35 through 38 (as designated in FIG. 1*a*).

Figure 4:
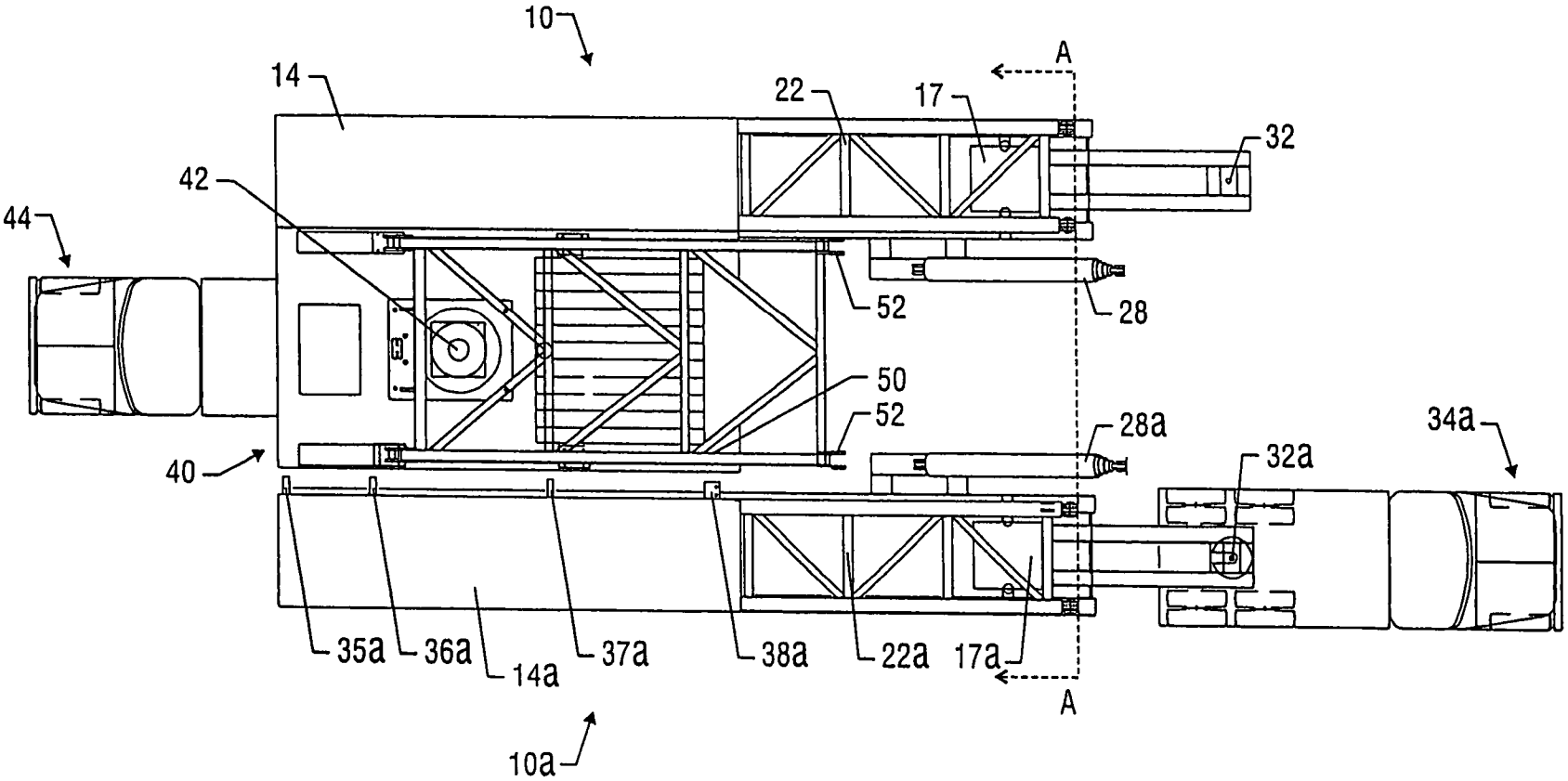
FIG. 4 is a top view of the driller's side side box positioned alongside the center drill floor section with a bottom mast section connected thereto according to one embodiment of the present invention.
Figure 4A:
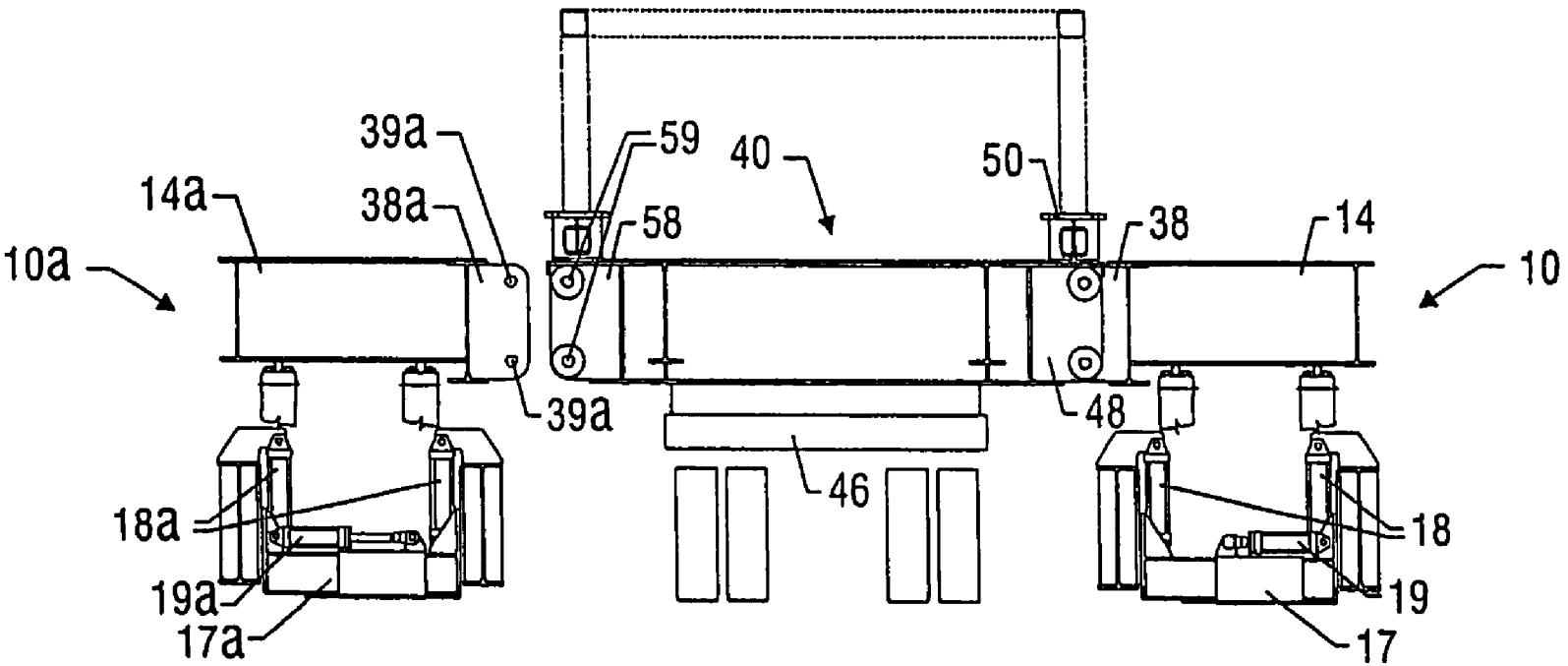
FIG. 4*a* is a front elevation view of the center drill floor section with a bottom mast section connected thereto positioned between the off-drillers side side box and the drillers side side box viewed along the line A-A as shown in FIG. 4.

The third step of the assembly sequence is shown in FIGS. 4 and 4*a*. As with the off-driller's side side box 10, the driller's side side box 10*a* is transported to the well site via a truck 34*a*. The side box 10*a* comprises the same primary structural components as side box 10: base side box 12*a*, drill floor side box 14*a*, telescoping diagonal brace 20*a*, front leg frame 22*a*, rear leg frame 24*a*, drill floor raising cylinder 26*a*, and mast raising cylinder 28*a*.

The side box 10*a* similarly includes a fifth-wheel connection 32*a* for connecting to a truck 34*a* and can be similarly attached to a wheeled transporter 30*a* (not shown) for transport of the side box 10*a* from location to location. The wheeled transporter 30*a* is removable from the side box 10*a* as discussed in relation to side box 10.

To connect side box 10*a* to the center drill floor section 40 in accordance with the preferred embodiment of the present invention (as shown in FIGS. 4 and 4*a*), the side box 10*a* is driven into position (from the drawworks side of the rig towards the V-door side of the rig) such that mating lug 38*a* attached to drill floor side box 14*a* is aligned in the front-to-back plane with mating lug 58 attached to the center drill floor section 40. After properly positioning side box 10*a* in relation to center drill floor section 40, positioning pads 16*a* and 17*a* "jack down" to support side box 10*a*, and side box 10*a* can be disconnected from the truck 34*a* and the wheeled transporter 30*a* in the same manner as described with reference to side box 10. The truck 34*a* and the wheeled transporter 30*a* may then be removed from the drill site.

Positioning pads 16*a* and 17*a* are used to "skid" side box 10*a* sideways until the pin holes 39*a* in mating lug 38*a* are aligned with the pin holes 59 in mating lug 58. Like positioning pads 16 and 17, positioning pads 16*a* and 17*a* utilize three hydraulic positioning cylinders—two vertical positioning cylinders 18*a* and one horizontal positioning cylinder 19*a*—to move side box 10*a* in the vertical and horizontal direction. As noted, one of skill in the art will appreciate that the number of positioning cylinders can vary depending on the size of the side boxes. Similarly, one of skill in the art will appreciate that alternative means for moving the side boxes may be employed.

After aligning the pin holes 39*a* and 59, the center drill floor section 40 can be pinned to the drill floor side box 14*a* in accordance with one embodiment of the present invention. In a similar fashion, pinned connections between the drill floor side box 14*a* and the center drill floor 40 are made at connection points 35*a* through 38*a*.

After connecting side boxes 10 and 10*a* to the center drill floor section 40 in this manner, the positioning pads 16, 16*a*, 17, and 17*a* are then used to remove the center drill floor section 40 from the trailer 46 on which it is transported. Specifically, vertical positioning cylinders 18 in positioning pads 16 and 17, and vertical positioning cylinders 18*a* in positioning pads 16*a* and 17*a*, are extended vertically until center drill floor section 40 is lifted off of the trailer 46 on which it is transported. Truck 44 and trailer 46 can then be removed from the drill site.

The hydraulic cylinders of the positioning pads, as well as the mast raising cylinders and drill floor raising cylinders discussed below, may be operated by a portable, diesel-powered hydraulic power unit. The use of a portable hydraulic power unit allows rig operators to assemble the rig without the need for power generators, allowing the rig operators to conduct parallel assembly operations that further speeds up the assembly time.

At this point, the substructure of the drilling rig has been transported to the drill site and reassembled. The use of positioning pads to precisely move the large sections of the drilling rig into position for connection greatly facilitates the connection of the center drill floor section to the drill floor side boxes and significantly reduces the time required to assemble the rig. Additionally, the use of positioning pads alleviates the need for a crane on site to connect the center drill floor section to the drill floor side boxes—further reducing the time and money required to assemble the rig.

Figure 5:
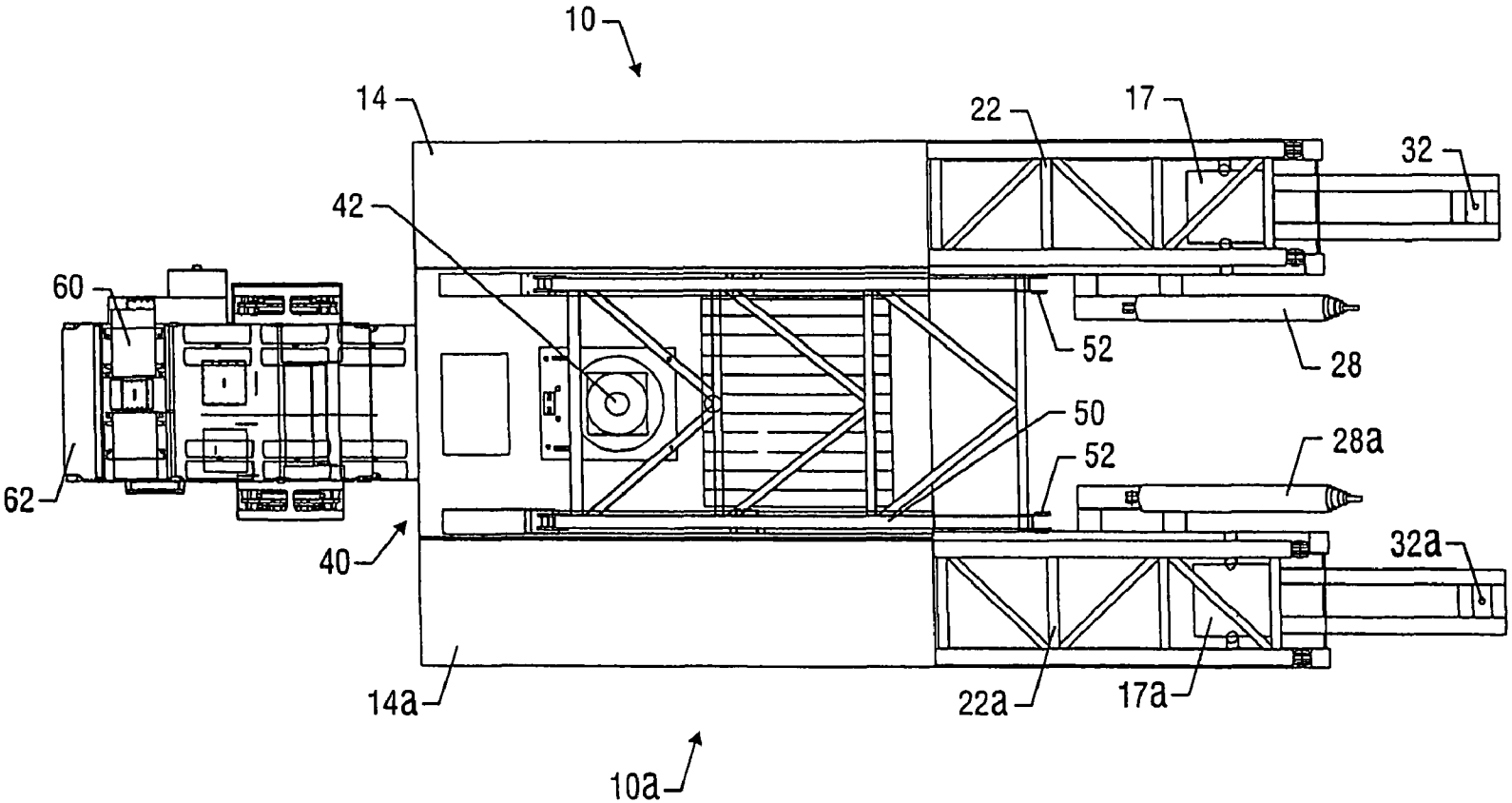
FIG. 5 is a top view of the drilling rig substructure shown in FIGS. 4 and 4*a* with a wheel mounted drawworks assembly positioned in relation to the substructure according to one embodiment of the present invention.

With the substructure assembled, the drawworks for the rig can be positioned and prepared for operation. FIG. 5 shows one embodiment of the present invention in which drawworks 60 is mounted on a wheeled trailer 62 and positioned at the drawworks side of the rig between the base side boxes 12 and 12*a*. In a preferred embodiment of the present invention, drawworks 60 is skid-mounted and remains on the trailer 62 during drilling operations. This differs from certain prior art drilling rigs that have the drawworks positioned on the drill floor during operations. By removing the drawworks 60 from the drill floor and placing it at or near ground level, the drill floor of the present invention can be smaller than the drill floor of certain prior art drilling rigs. A smaller drill floor equates to a lighter drill floor that is easier to transport and to connect to the side boxes of the rig. One of skill in the art will appreciate, however, that the rig floor of the present invention can be designed such that the drawworks is mounted on the drill floor for operation.

With the substructure in position and assembled—but still at ground level, the mast of the drilling rig can be assembled and connected to the center drill floor section. In accordance with alternative embodiments of the present invention, the mast may be attached to the center drill floor section either from the V-door side of the rig or from the drawworks side of the rig. The operator of the drilling rig must—prior to manufacture of the rig—chooses from which side of the rig the mast will be connected, as it is a function of the oil and gas lease boundaries. Specifically, in the lowered position (i.e., at or near ground level), the mast may be too long such that it extends beyond the real property boundaries of the lease when attached from one side of the rig but not when attached from the other side of the rig. Which side the operator chooses to attach the mast from is dependent on where the well center is in relation to the lease property lines.

Figure 6:
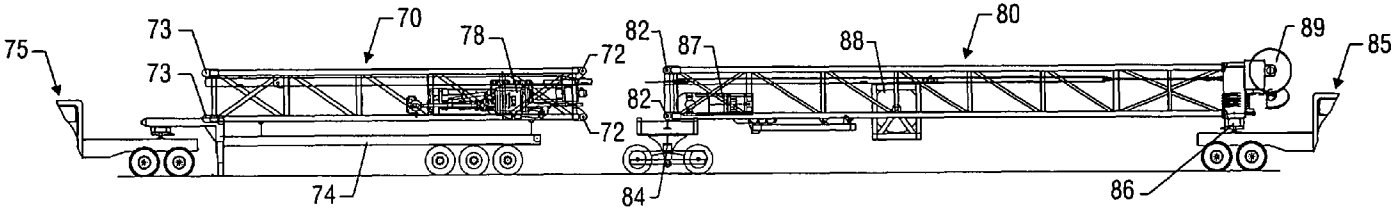
FIG. 6 is a side view of a wheel mounted lower section and top section of a three-section drilling rig mast according to one embodiment of the present invention.
Figure 7:
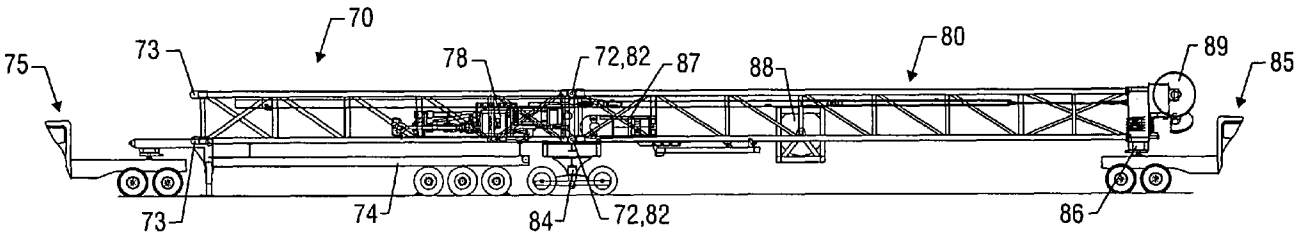
FIG. 7 is a side view showing the lower section and top section of a three-section drilling rig mast connected together according to one embodiment of the present invention.
Figure 8:
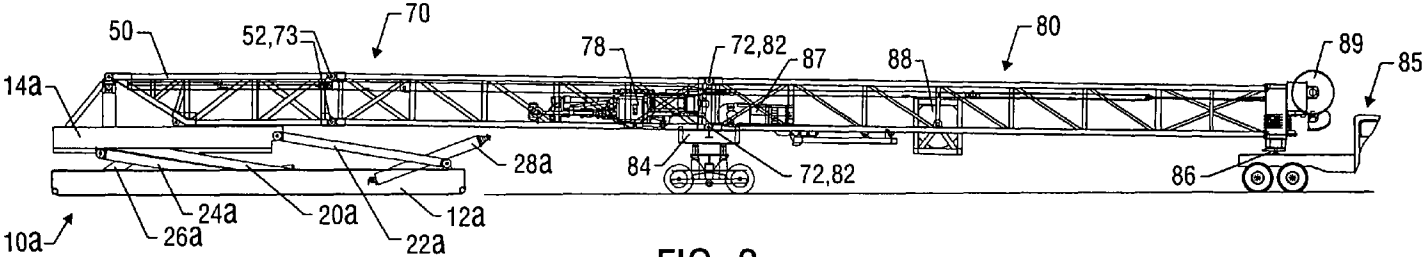
FIG. 8 is a side view showing the lower section and top section of a three-section drilling rig mast connected to the bottom section of the mast according to one embodiment of the present invention.

In one embodiment of the present invention, the mast is connected to the center drill floor section on the V-door side of the rig—as shown in FIGS. 6-8. The mast is broken down into three sections: bottom section 50, lower section 70, and top section 80. Depending on the size of the drilling rig mast, the mast may be broken down into fewer or more sections. When the mast is connected from the V-door side of the rig, the mast bottom section 50 is attached to the center drill floor section as shown in FIGS. 2-5.

As can be seen in FIG. 6, the lower section 70 is transported via trailer 74 to the drill site with top drive 78 already installed within the lower section 70. At the drill site, truck 75 backs the trailer 74 into rough alignment with the bottom section 50 attached to the center drill floor section 40. Lower section 70 includes mast connecting lugs 73 that are designed to mate with mast connecting lugs 52 on the bottom section 50. Similarly, lower section 70 also includes mast connecting lugs 72 designed to mate with mast connecting lugs 82 on the top section 80.

Top section 80 is transported to the drill site via truck 85 and positioning dolly 84. Truck 85 is used to back the top section 80 into rough alignment with the lower section 70 and the bottom section 50. Top section 80 is transported with the drill line spooler 88, the traveling block 87, and the crown block 89 already installed. Before the rig is broken down for transport, the drill line is unspooled from the drawworks so that it may be transported with the traveling block 87 and crown 89. The drill line that is unspooled from the drawworks is coiled around the drill line spooler 88 for transport. Transporting the drill line, the drill line spooler 88, the traveling block 87, and the crown block 89 together within top section 80 alleviates the need to unstring the traveling block 87 for transportation—thus saving significant rig up time at the drill site.

Having roughly aligned the lower section 70 and the top section 80 with the bottom section 50 attached to the center drill floor section 40, the top section 80 is backed-up so that mast connecting lugs 82 are aligned with mast connecting lugs 72. Aligning the mast connecting lugs 82 and 72 is facilitated by the positioning dolly 84 attached to the lower end of the top section 80. Through use of hydraulic cylinders, positioning dolly 84 can raise, lower, or move from side-to-side the lower end of top section 80. Additionally, fifth-wheel connection 86 that holds the top of the top section 80 in place during transport may also be equipped with hydraulic cylinders that can raise, lower, or move from side-to-side the top of the top section 80—further facilitating the alignment of the mast connecting lugs 82 and 72. Once the mast connecting lugs 82 and 72 are aligned, top section 80 and lower section 70 are pinned together as shown in FIG. 7.

FIG. 8 shows the connection of the bottom section 50 to the remainder of the mast. After pinning together top section 80 and lower section 70, positioning dolly 84 raises the mast sections up until the lower section 70 is free from trailer 74, and the trailer 74 can be removed. Truck 85 is then used to back up the connected mast sections 70 and 80 until the mast mating lugs 73 on the lower end of the lower section 70 mate with the mast connecting lugs 52 on bottom section 50 already attached to the center drill floor section 40. The aligning of the mast mating lugs 52 and 73 is facilitated by positioning dolly 84 and fifth-wheel connection 86 as described above. When properly aligned, bottom section 50 is pinned to lower section 70, and the mast is ready to be raised.

In an alternative embodiment of the present invention, both the lower section 70 of the mast and the top section 80 of the mast can be transported to the drill site via a trailer similar to trailer 74. In lieu of using positioning dolly 84, the trailers carrying the mast sections will have positioning cylinders similar to those employed in positioning dolly 84 on the trailer. In this way, the mast can be aligned and assembled in the same way as described with respect to the embodiment utilizing positioning dolly 84.

Figure 9:
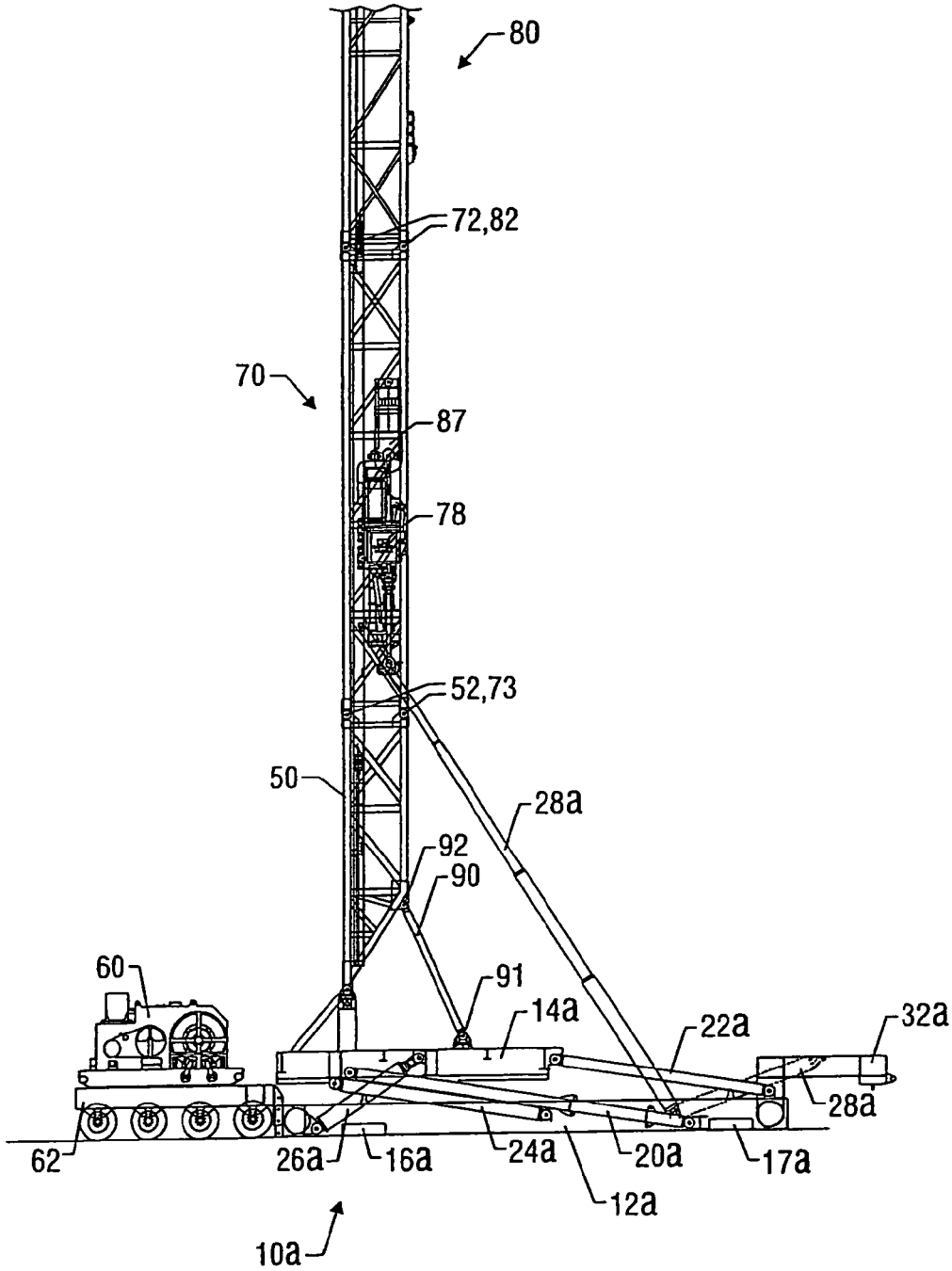
FIG. 9 is a side view showing the raising of the drilling rig mast shown in FIGS. 6-8 by hydraulic mast-raising cylinders according to one embodiment of the present invention.

Raising of the mast is shown in FIG. 9. To raise the mast, hydraulic mast raising cylinders 28 and 28*a* (that are attached to base side boxes 12 and 12*a*) are connected to the mast lower section 70. The mast raising cylinders 28 and 28*a* are extended hydraulically, thereby raising the mast from a substantially horizontal position to a substantially vertical, drilling position. FIG. 9 shows mast raising cylinder 28*a* in both the non-extended position and in the extended position for illustration purposes only. Additionally, although one mast raising cylinder attached to each side box is shown in the preferred embodiment, one of skill in the art will recognize that the number of mast raising cylinders may vary depending on the size of the mast. A total of one mast raising cylinder may be sufficient for raising smaller masts, while one or more mast raising cylinders per side box may be required for larger masts.

After raising the mast—and while the mast raising cylinders 28 and 28*a* are still holding the mast in the raised position, mast support legs 90 and 90*a* are "swung" down from the mast and pinned to the center drill floor 40 to secure the mast in the raised position. Mast raising cylinders 28 and 28*a* can then be disconnected from the mast and retracted.

In an alternative embodiment of the present invention, the drilling rig mast can be connected to the center drill floor section from the drawworks side of the rig—as shown in FIGS. 10-12*b*. In this embodiment, the mast is broken down into two sections: lower section 70 and top section 80. Similar to the three-section mast connected from the V-door side of the rig, top section 80 is transported with crown block 89, drill line spooler 88 and traveling block 87 already in place, while lower section 70 is transported with top drive 78 already in place. The lower section 70 of the two-section mast connected from the drawworks side of the rig differs from the three-section mast connected from the V-door side in that bottom section 50 (shown in FIGS. 2-5 and 8) is now an integral part of lower section 70.

Figure 10:
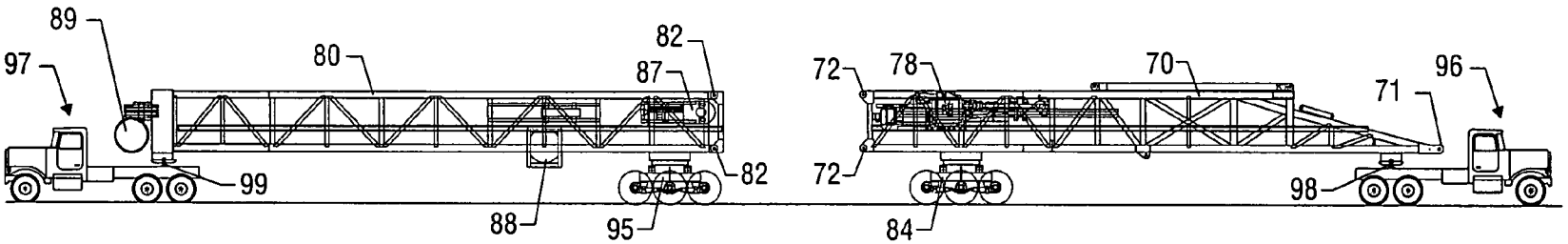
FIG. 10 is a side view of the wheel mounted lower section and top section of a two-section drilling rig mast according to one embodiment of the present invention.

As can be seen in FIG. 10, both mast sections have their own wheeled dollies and fifth-wheel connections for transportation by trucks. Lower section 70 is connected to positioning dolly 84, while top section 80 is connected to non-adjustable dolly 95. The mast sections 70 and 80 are connected together through use of the positioning dolly 84 and fifth-wheel connection 98 in a similar fashion as described above with regard to the three-section mast connected from the V-door side of the rig. Although dolly 95 is a non-adjustable dolly in one-embodiment of the present invention, one of skill in the art will recognize that both wheeled dollies 84 and 95 may be adjustable or only wheeled dolly 95 may be adjustable. One of skill in the art will appreciate that the objectives of the present invention can be accomplished through the use of various combinations of adjustable wheeled dollies and fifth wheel connections.

Figure 11:
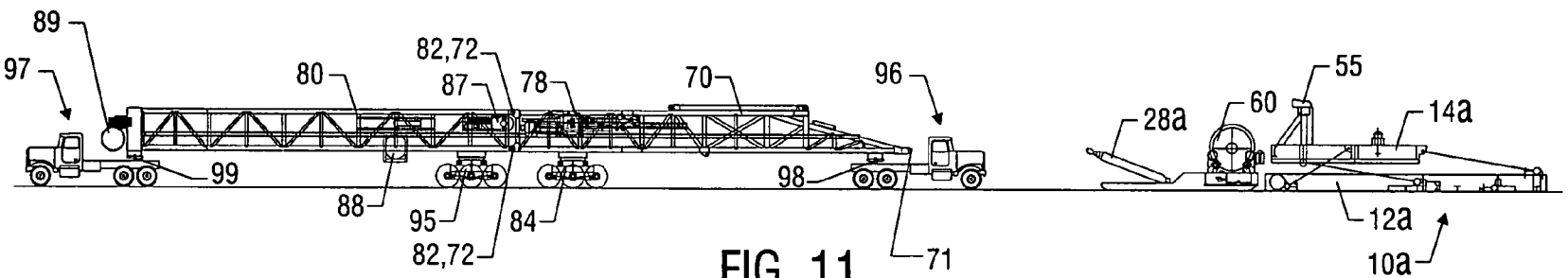
FIG. 11 is a side view showing the lower section and top section of a two-section drilling rig mast connected together according to one embodiment of the present invention.

Truck 97 drives the lower section 70 into rough alignment with the mast connection point on the center drill floor section on the drawworks side of the drilling rig. Truck 97 then backs in top section 80 such that mast connecting lugs 82 are in rough alignment with mast connecting lugs 72. Positioning dolly 84 and the adjustable fifth-wheel connection 99 are then used to align the pin holes in mast connecting lugs 82 and 72 so that the top section 80 and lower section 70 can be pinned together as shown in FIG. 11.

Figure 12:
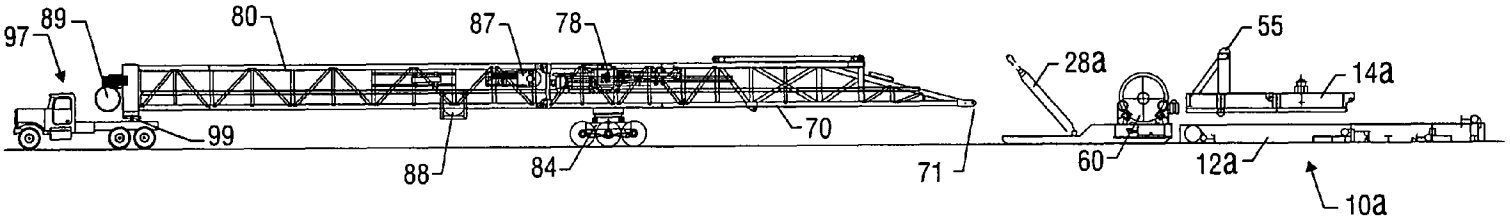
FIGS. 12 through 12*b* are side views showing the connection of a two-section drilling rig mast to the center drill floor section according to one embodiment of the present invention.
Figure 12A:
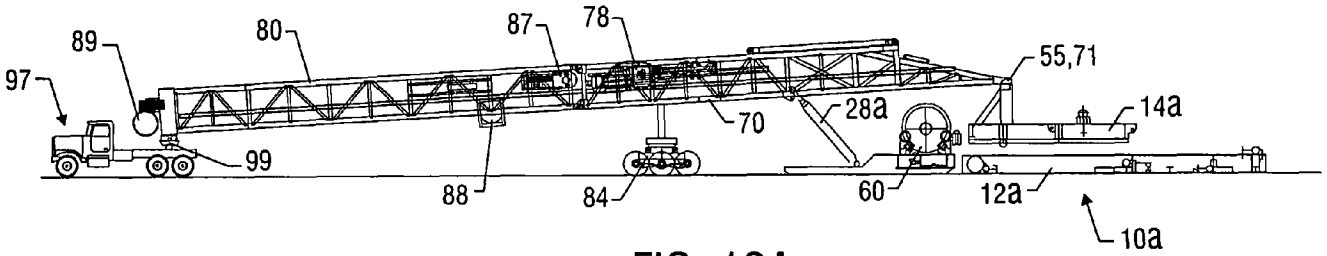
Figure 12B:
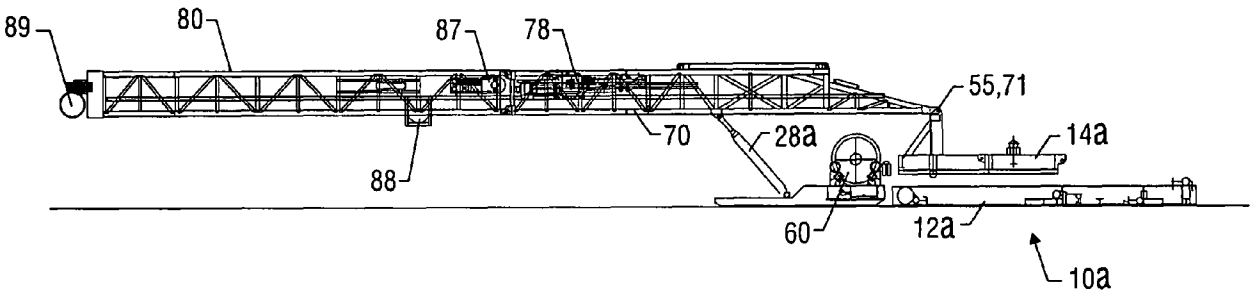

Once top section 80 and lower section 70 are pinned together, positioning dolly 84 raises the mast up so that the non-adjustable dolly 95 can be disconnected from the top section 80 and so that the fifth-wheel connection 98 of the lower section 70 can be disengaged from truck 96 as shown in FIGS. 12-12*b*. Non-adjustable dolly 95 and truck 96 can then be removed from the drill site.

Truck 97 and positioning dolly 84 are then used to back up the connected mast until it lines up with the mast connecting assembly 55 on the center drill floor 40. Again, lining up the mast for connection to the center drill floor 40 is facilitated by the positioning dolly 84 and the adjustable fifth-wheel connection 99. Positioning dolly 84 may be used to lift the mast to vertically align mast connecting lugs 71 with mast connecting assembly 55. Once aligned, mast connecting lugs 71 on the lower end of lower section 70 are pinned to lugs on the mast connecting assembly 55 on the center drill floor section 40. The mast is now connected to the center drill floor section 40.

One of skill in the art will appreciate that alternative embodiments of the present invention can be employed to carry the mast sections to the drill site and to facilitate the connection of the mast sections. As with a three-section mast connected from the V-door side, one such alternative embodiment includes the use of trailers with positioning cylinders on the trailer for facilitating the alignment and connection of the mast sections.

Once pinned in place, the mast raising cylinders 28 and 28*a* are connected to the mast. The load from the weight of the mast can then be carried by the mast raising cylinders 28 and 28*a* such that the positioning dolly 84 can be disengaged from the mast, fifth-wheel connection 99 can be disengaged from truck 97, and truck 97 and positioning dolly 84 can be removed from the drill site as shown in FIG. 12*b*.

Figure 13:
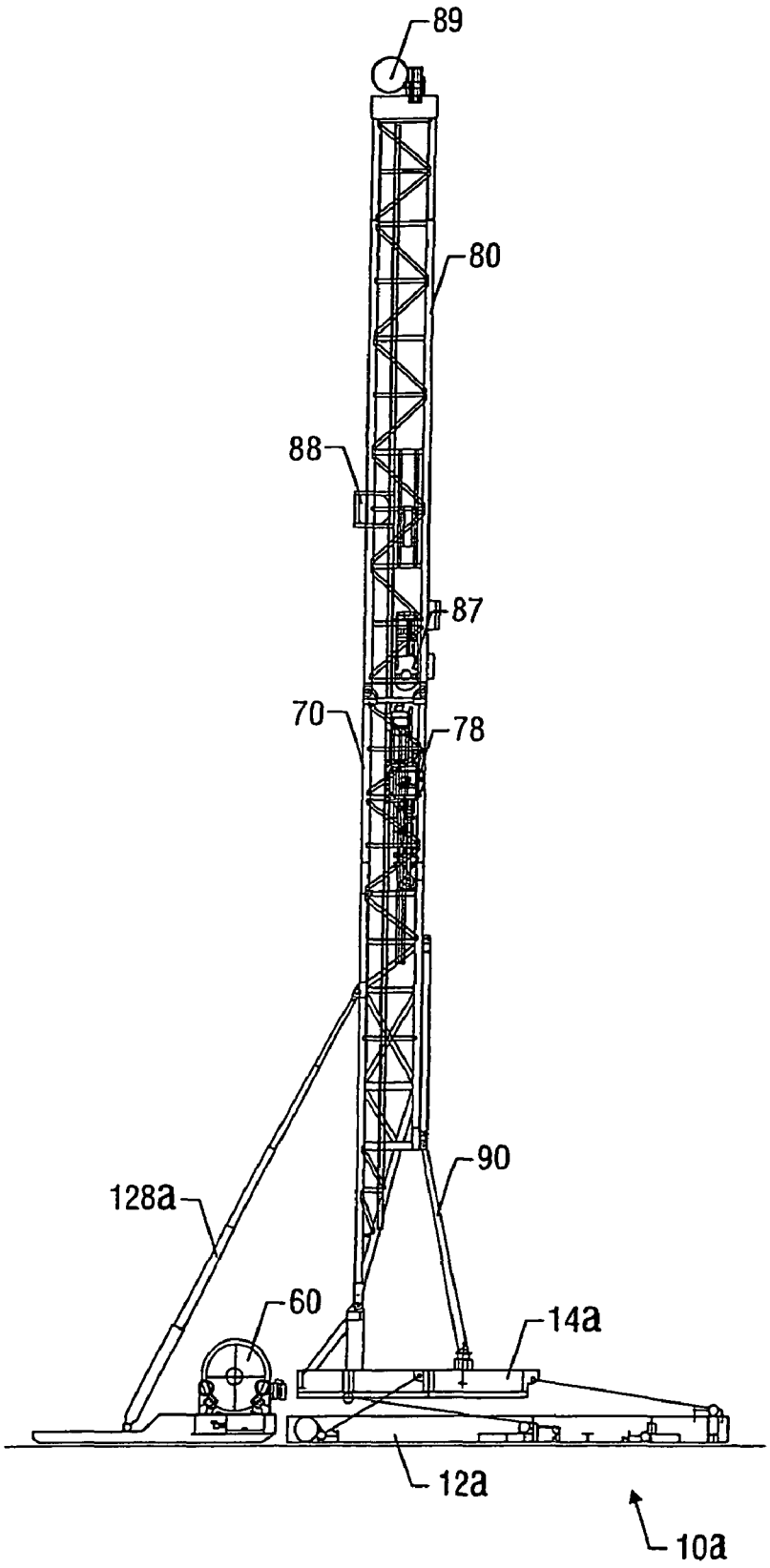
FIG. 13 is a side view showing the two-section drilling rig mast of FIGS. 10-12*b* raised into position by hydraulic mast raising cylinders.

After disengaging positioning dolly 84 and fifth-wheel connection 99, the mast raising cylinders 28 and 28*a* are used to raise the mast to the operational position as shown in FIG. 13. FIG. 13 shows the mast support leg 90 "swung" down into drilling position and pinned to the center drill floor section 40, securing the mast in the raised position (as discussed above with reference to the three-section mast connected from the V-door side of the rig).

Figure 14:
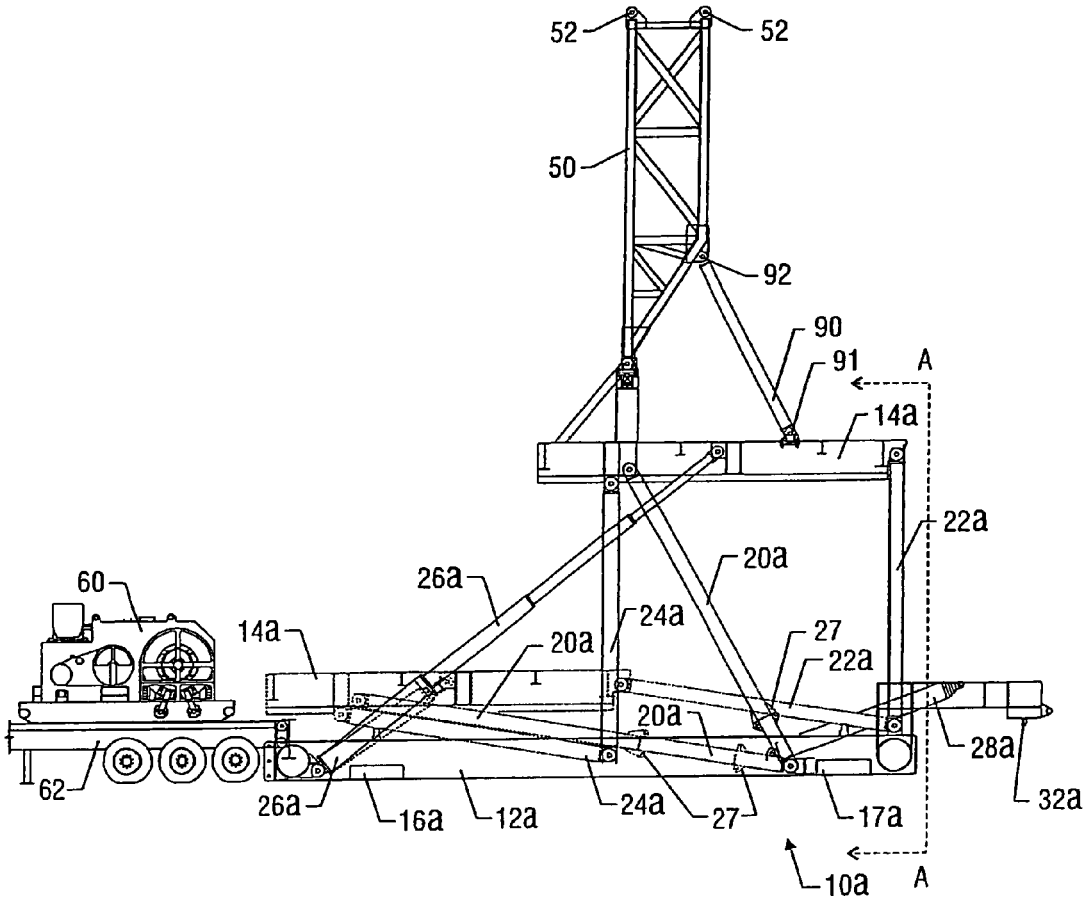
FIG. 14 is a side view from the driller's side of the drilling rig showing the raising of the complete drill floor by the hydraulic drill floor raising cylinders according to one embodiment of the present invention.
Figure 14A:
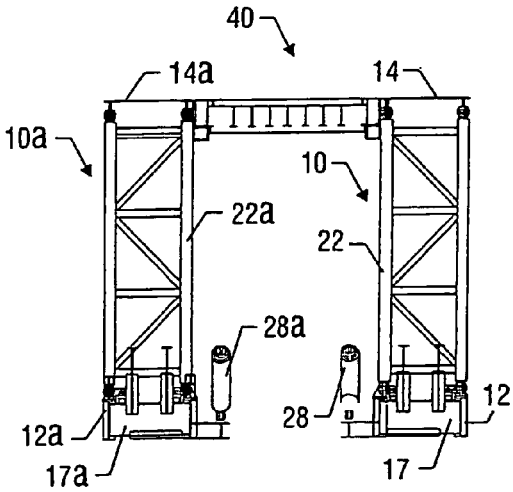
FIG. 14*a* is a front elevation view of the complete drill floor raised into position viewed along the line A-A as shown in FIG. 14.

With the mast fully assembled and in the raised, operational position, the drill floor can be raised to its elevated position as shown in FIGS. 14 and 14*a*. To raise the drill floor, hydraulically activated drill floor raising cylinders 26 and 26*a* telescope outwardly and raise the entire drill floor—comprising drill floor side boxes 14 and 14*a* connected to center drill floor section 40. One of skill in the art will appreciate that the number of drill floor raising cylinders will vary depending on the size of the drilling rig. For larger drilling rigs, one or more drill floor raising cylinders attached to each side box may be required to raise the drill floor, while a total of only one drill floor raising cylinder may be required for smaller rigs.

As the drill floor raising cylinders 26 and 26*a* exert force on the drill floor, front leg frames 22 and 22*a* pivot around their connection point to the base side boxes 12 and 12*a* respectively until they reach the vertical or substantially vertical position shown in FIGS. 10 and 10*a*. Similarly, rear leg frames 24 and 24*a* pivot around their connection points to base side boxes 12 and 12*a* respectively until they reach the vertical or substantially vertical position. FIG. 14 shows the drill floor in both the lowered position (as shown with dashed lines) and in the raised position.

One of skill in the art will appreciate that the number of leg frames used to support the drill floor in the elevated position may vary depending on the size of the drill floor. For larger drill floors, three or more leg frames per side box may be needed, while smaller drill floors may only require two leg frames per side box.

To prevent front leg frames 22 and 22*a* and rear leg frames 24 and 24*a* from rotating past the vertical position, telescoping diagonal braces 20 and 20*a*—which are normally in the extended position when the drill floor is at ground level—pivot to their operational position shown in FIG. 14. As the drill floor is raised, the concentric cylinders of the telescoping diagonal braces 20 and 20*a* telescope inwardly—thus causing the braces to get shorter. When the drill floor reaches the correct elevation (at which point the front and rear leg frames are in the vertical or substantially vertical position), the telescoping diagonal braces 20 and 20*a* "bottom out" and prevent further raising of the drill floor. One of skill in the art will recognize that the number of telescoping diagonal braces attached to the side boxes may vary depending on the size of the drilling rig. For larger drilling rigs, more than one telescoping diagonal brace attached to each side box may be required. For smaller drilling rigs, a total of one telescoping diagonal brace may only be required.

The telescoping diagonal braces 20 and 20*a* have mating lug assemblies 27 positioned on both concentric circles of the braces that "mate" at the bottomed-out position. Mating lug assemblies 27 each have two pin holes that are aligned in the bottomed-out position. When pinned together, these mating lug assemblies 27 lock the telescoping diagonal braces 20 and 20*a* in place and secure the drill floor in the elevated position. As can be seen in FIG. 14, the mating of the mating lug assemblies 27 occurs at or near ground level such that the telescoping diagonal braces 20 and 20*a* are pinned at or near ground level.

The telescoping diagonal braces 20 and 20*a* of the present invention differ from prior art bracing members. In prior art elevated floor drilling rigs, such as disclosed in U.S. Pat. No. 4,831,795 to Sorokan, the substructure of the rig utilizes a "gin pole" assembly to help raise the drill floor and to help secure it in place. These gin pole assemblies add weight to the substructure and, thus, can be cumbersome to transport from location to location. Additionally, it is necessary to erect these gin pole assemblies before elevating the drill floor. Further, after the rig floor is raised, the gin pole assemblies are secured in place by pinning them at a connection point on the elevated drill floor. Pinning these gin pole assemblies at an elevated position can be more difficult, more time consuming, and more dangerous for rig personnel. The present invention eliminates the need for gin pole assemblies, as it uses hydraulic cylinders to raise the drill floor and uses telescoping diagonal braces 20 and 20*a* to secure the drill floor in the elevated position. An added advantage of using the telescoping diagonal braces 20 and 20*a* is that the braces are secured by pinning at or near ground level, making the task of pinning them in place faster, easier, and safer.

In an alternative embodiment of the present invention shown in FIGS. 15 through 17*b*, a non-wheeled, or skidded, substructure is utilized. In this alternative embodiment, side boxes 100 and 100*a* are the same as side boxes 10 and 10*a* discussed above except that they lack positioning pads 16 and 17 and 16*a* and 17*a* respectively. The structural components of side boxes 100 and 100*a* are shown with reference to FIGS. 11 and 12 and comprise: base side boxes 105 and 105*a*, drill floor side boxes 110 and 110*a*, telescoping diagonal braces 120 and 120*a*, front leg frames 122 and 122*a*, rear leg frames

124 and 124*a*, drill floor raising cylinders 126 and 126*a*, and mast raising cylinders 128 and 128*a*.

Figure 15:
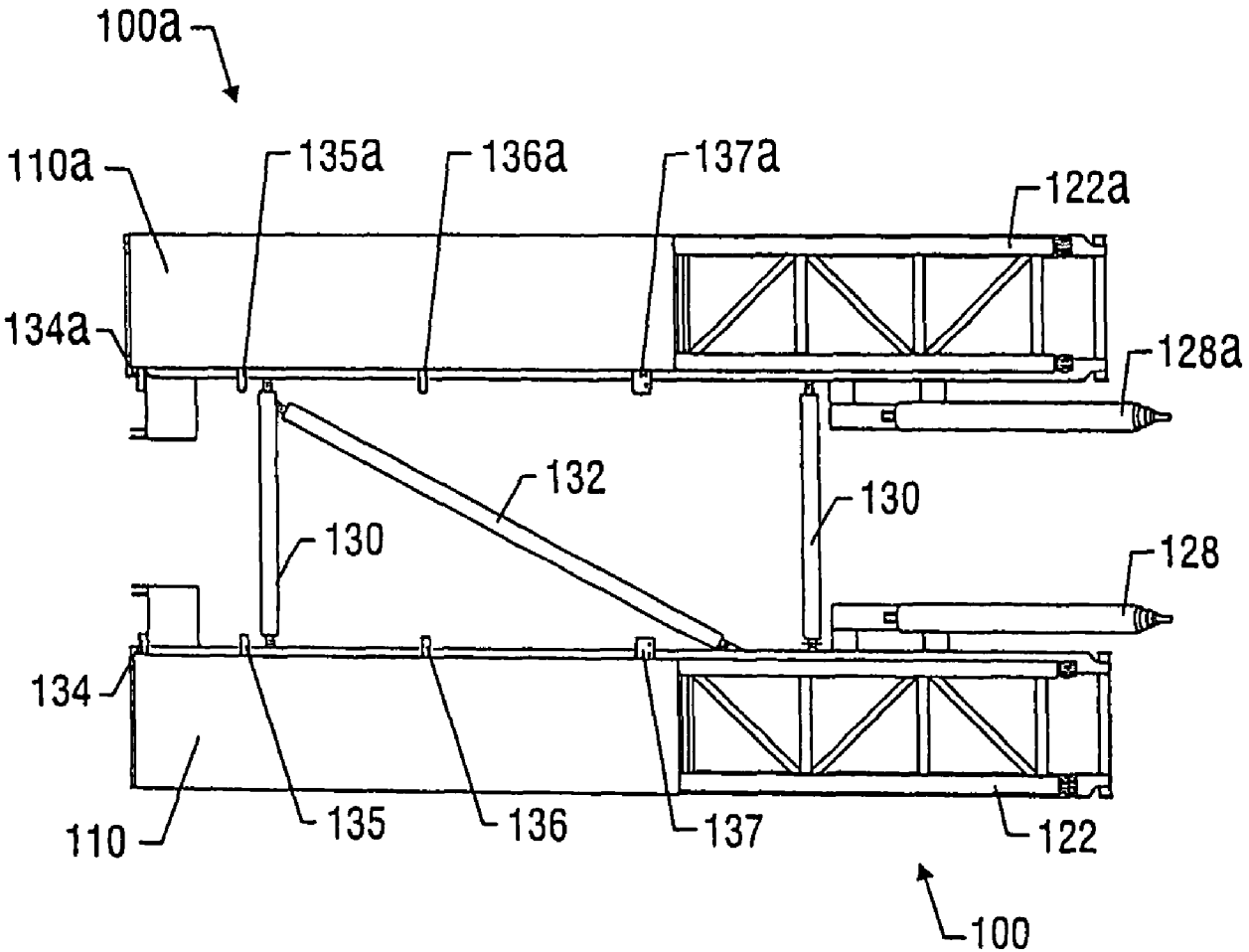
FIG. 15 is a top view showing the off-driller's side side box positioned relative to and properly spaced apart from the driller's side side box through the use of spreader beams according to one embodiment of the present invention.

In assembling the substructure according to this embodiment, the substructure similarly consists of three sections: side boxes 100 and 100*a* and center drill floor section 140. The two side boxes 100 and 100*a* are first trucked to the well site and lined up with the well center. The side boxes 100 and 100*a* can be off-loaded from the trailer by a crane, if available, or can be pulled from the trailer by a winch truck. As shown in FIG. 15, the positioning of side boxes 100 and 100*a* is facilitated through the use of horizontal spreaders 130 and diagonal spreader 132 that ensure the side boxes 100 and 100*a* are properly spaced and aligned.

Once side boxes 100 and 100*a* are in position, the center drill floor section 140 must be connected to drill floor side boxes 110 and 110*a*. In accordance with one embodiment of the present invention, center drill floor section 140 is connected to drill floor side boxes 110 and 110*a* at connection points 134 through 137 and 134*a* through 137*a* shown in FIG. 15. One of skill in the art will appreciate that the number of connection points for connecting the center drill floor section 140 to drill floor side boxes 110 and 110*a* may vary depending on the size of the drilling rig.

Figure 16:
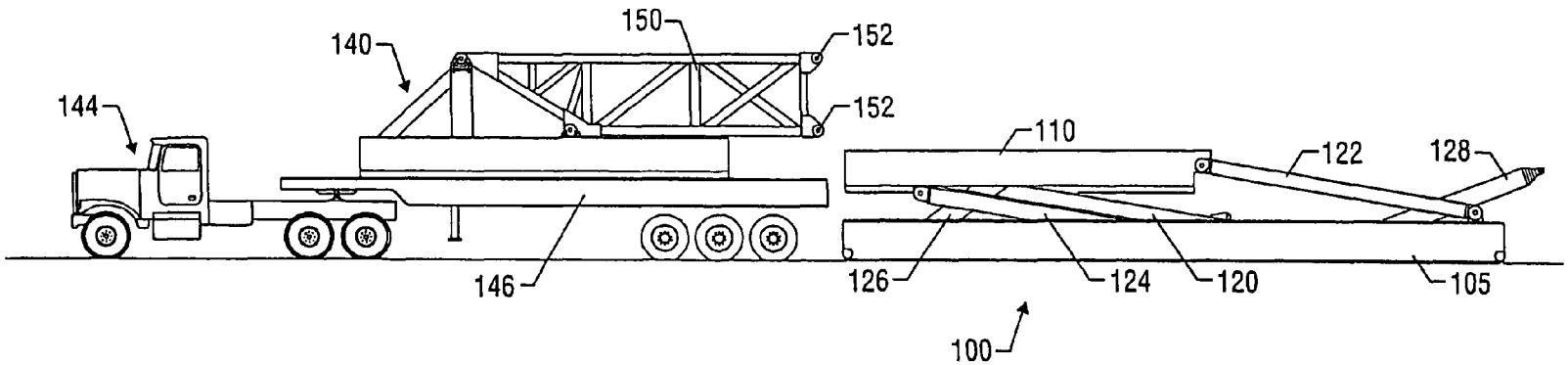
FIG. 16 is a side view of a truck mounted center drill floor section in position for connection to the drill floor side boxes according to one embodiment of the present invention.
Figure 17:
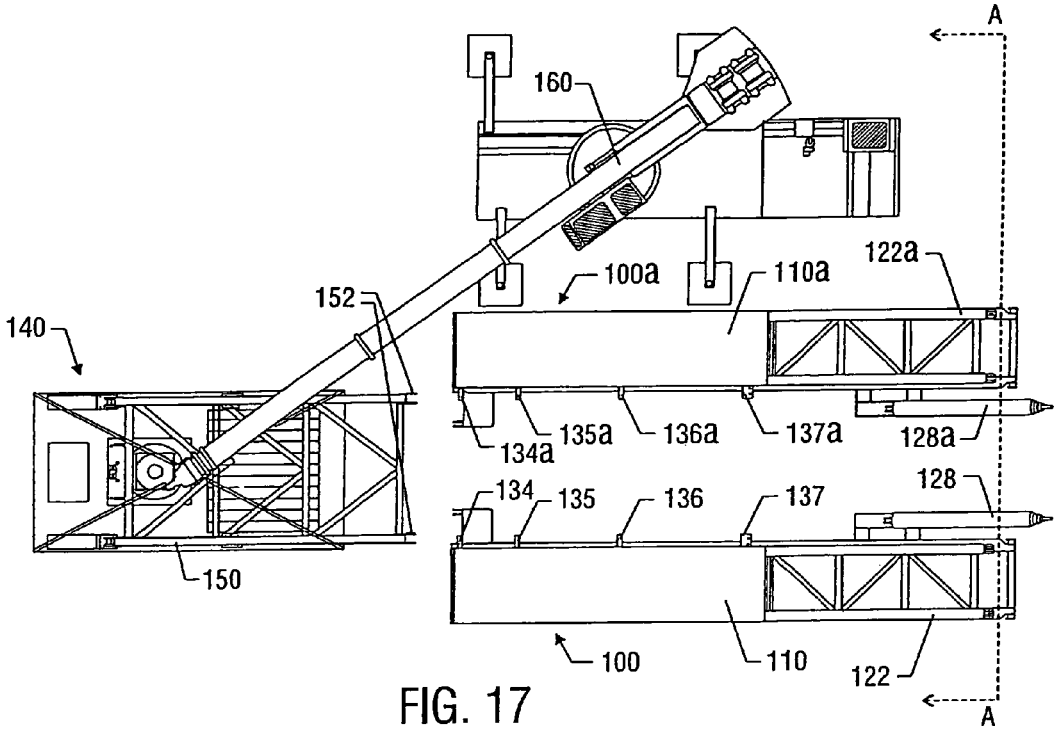
FIG. 17 is a top view showing the connection of the center drill floor section to the drill floor side boxes through the use of a crane according to one embodiment of the present invention.
Figure 17A:
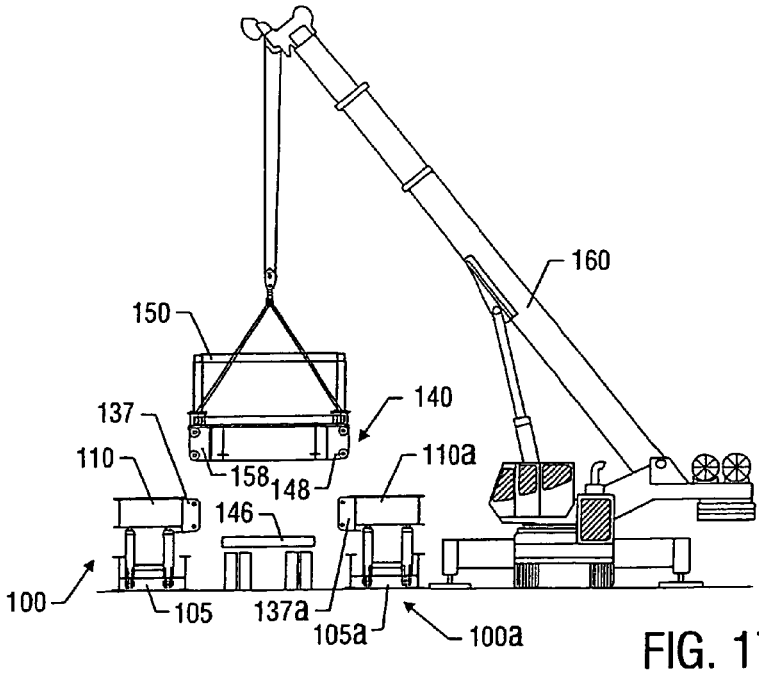
FIG. 17*a* is a front elevation view showing the connection of the center drill floor section to the drill floor side boxes through the use of a crane as viewed along the line A-A shown in FIG. 17.

As can be seen in FIG. 16, center drill floor section 140 is transported to the drill site on trailer 146 attached to truck 144. Trailer 146 is backed into position near side boxes 100 and 100*a*. Crane 160 is then used to lift center drill floor section 140 off of trailer 146 as show in FIGS. 17 and 17*a*. Center drill floor section 140 is then lowered into position such that it is connected to drill floor side boxes 110 and 110*a* at connection points 134-137 and 134*a*-137*a* using the improved structural connector disclosed in U.S. Provisional Patent Application Ser. No. 60/463,882 to Palidis filed Apr. 17, 2003. U.S. Provisional Patent Application Ser. No. 60/463,882 is incorporated herein in its entirety by reference.

Figure 17B:
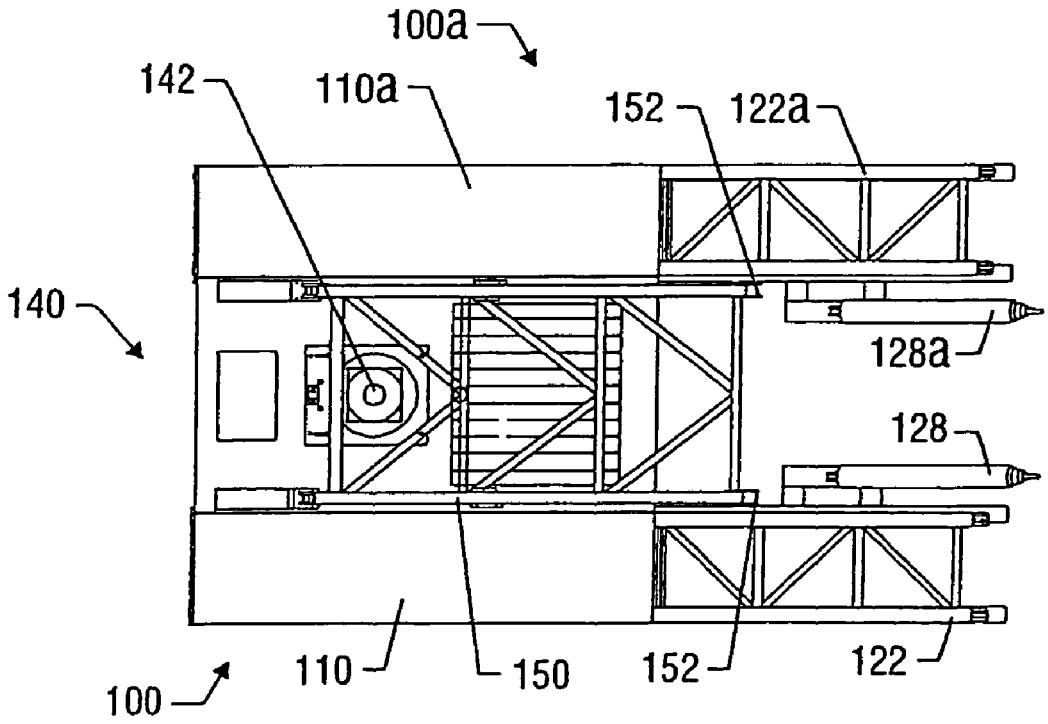
FIG. 17*b* is a top view showing the center drill floor section connected to the drill floor side boxes through the use of a crane as shown in FIGS. 17 and 17*a*.

FIG. 17*b* shows center drill floor section 140 connected to drill floor side boxes 110 and 110*a*. Center drill floor section 140 may or may not have mast bottom section 150 already attached to it when center drill floor section 140 is connected to drill floor side boxes 110 and 110*a*. Whether mast bottom section 150 is attached to center drill floor section 140 will depend on whether the drilling rig mast will be connected to the center drill floor section 140 from the V-door side of the rig or from the drawworks side of the rig. Regardless of which side the mast will be connected from, once the center drill floor section 140 is in place, the mast sections are assembled together, connected to the center drill floor section 140, and raised by mast raising cylinders 128 and 128*a* in the same manner as discussed above with regard to FIGS. 6-13.

Additionally, once the drilling rig mast is connected to center drill floor section 140 and raised into operational position, the drill floor raising cylinders telescope outwardly and raise the entire drill floor—comprising drill floor side boxes 110 and 110*a* connected to center drill floor section 140. The process of raising the entire drill floor and securing it in the elevated position is accomplished in the same manner as discussed above with regard to FIGS. 14 and 14*a*.

Figure 18:
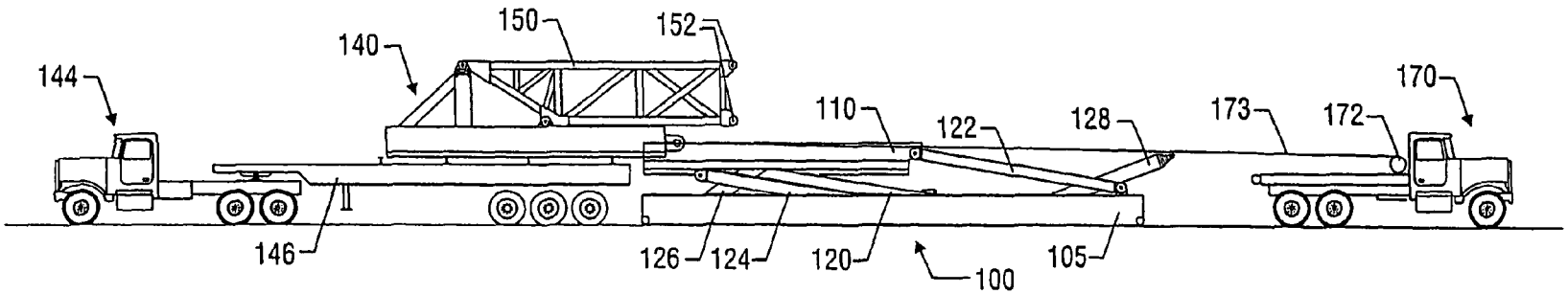
FIG. 18 is a side view showing the connection of a center drill floor section to drill floor side boxes using a guide bar system according to one embodiment of the present invention.
Figure 18A:
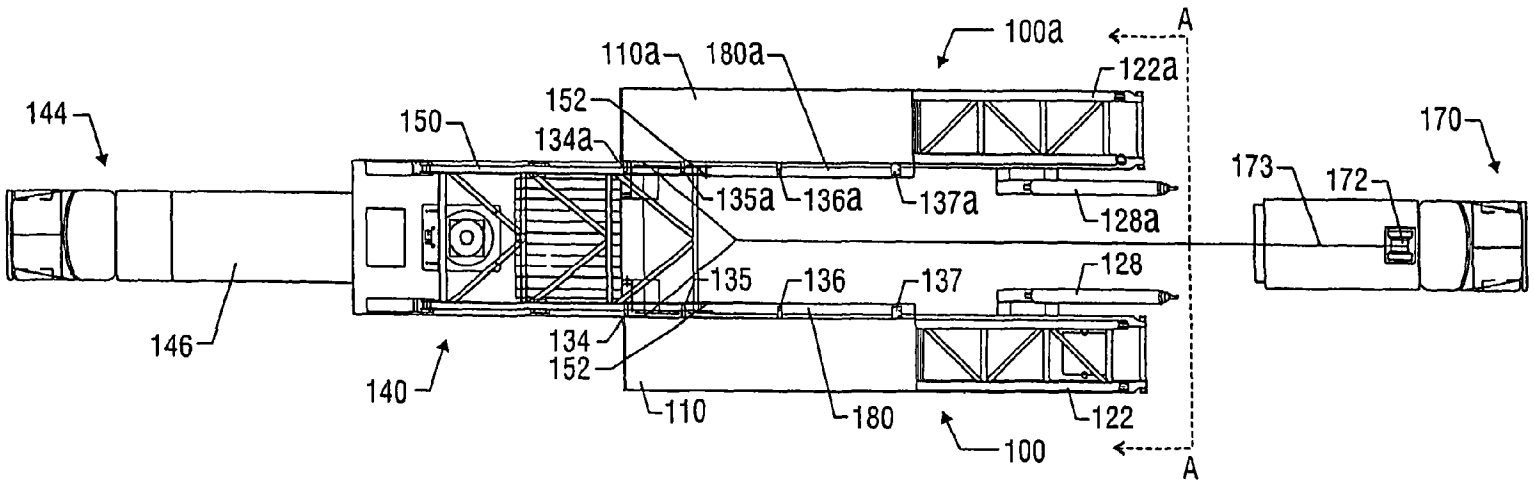
FIG. 18*a* is a top view showing the connection of a center drill floor section to drill floor side boxes using a guide bar system according to one embodiment of the present invention.
Figure 19:
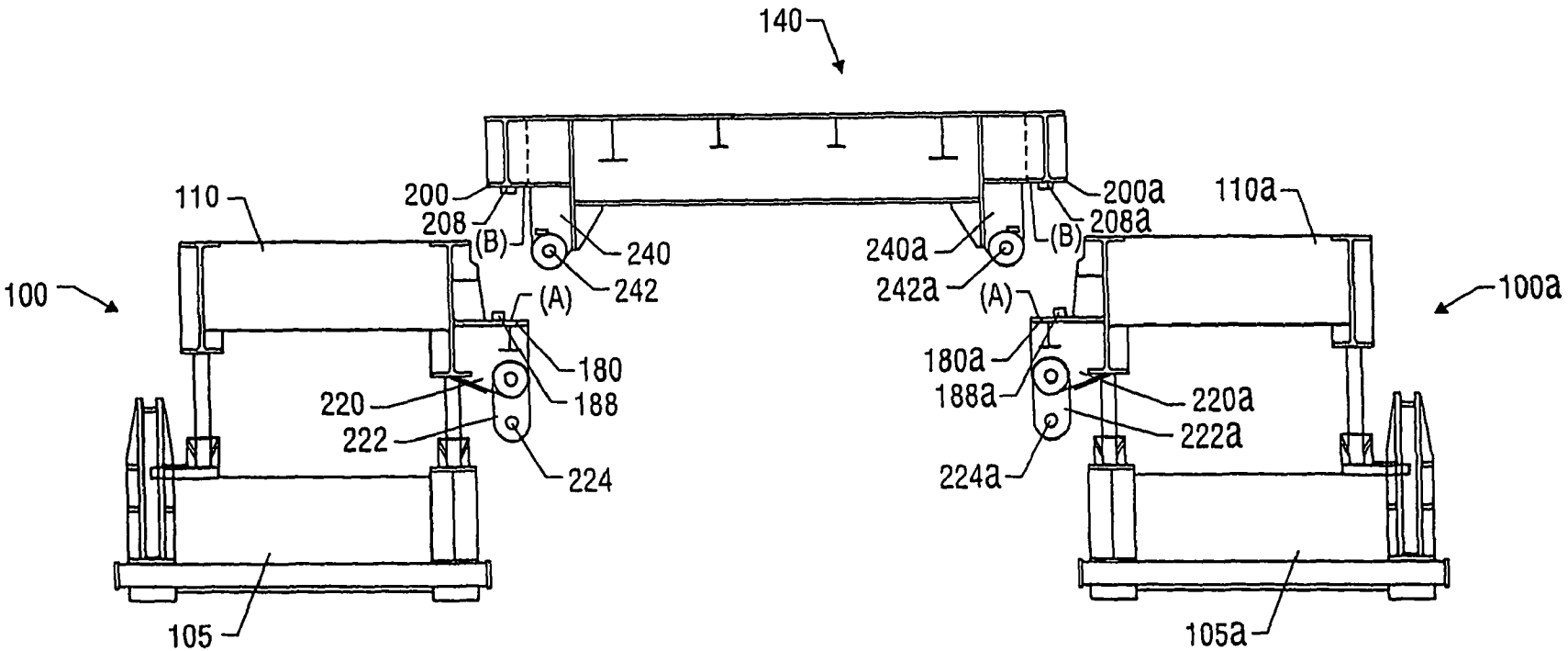
FIG. 19 shows a front elevation view of the center drill floor section and drill floor side boxes with a guide bar system viewed along the line A-A as shown in FIG. 18*a*.
Figure 20:
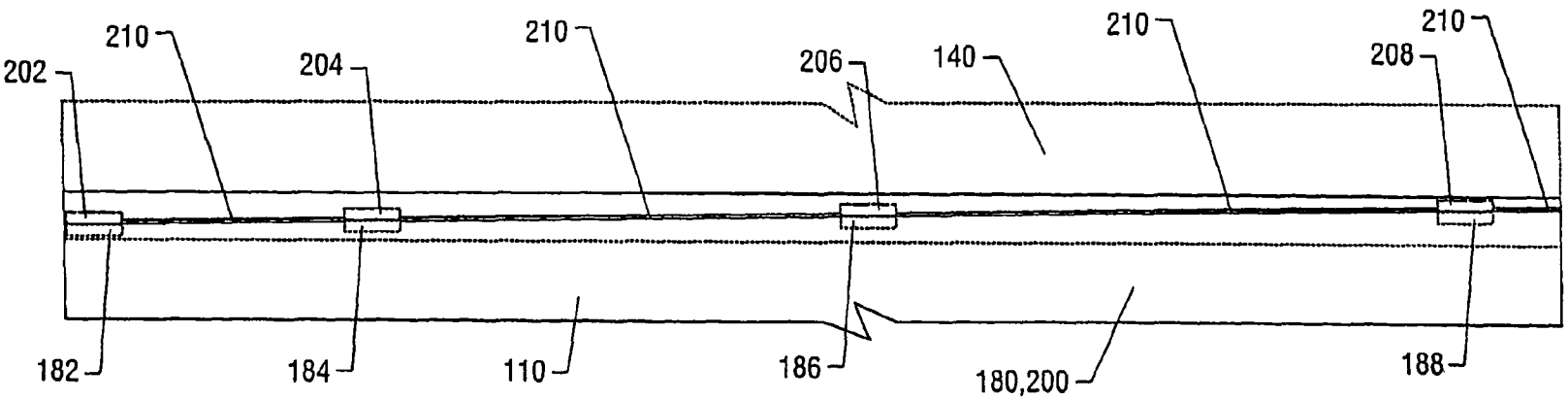
FIG. 20 is top view of a support rail of the driller's side drill floor side box showing the guide bar and mating blocks of the guide bar system used to facilitate the connection of the center drill floor section to the drill floor side boxes according to one embodiment of the present invention.

In an alternative embodiment of the present invention shown in FIGS. 18-20, a drilling rig can be assembled at the drill site without the use of a crane. According to this embodiment of the present invention, the side boxes 100 and 100*a* are positioned and aligned as discussed above with reference to FIG. 15. As shown in FIGS. 18*a* and 19, the side boxes 100 and 100*a* have support rails 180 and 180*a* attached to the drill floor side boxes 110 and 110*a* respectively. Corresponding support rails 200 and 200*a* are attached to center drill floor section 140 as shown in FIG. 19.

To connect the center drill floor section 140 to the drill floor side boxes 110 and 110*a*, a winch 172 (mounted on winch truck 170) and winch line 173 are used to pull or "skid" the center drill floor 140 onto the support rails 180 and 180*a* attached to the drill floor side boxes 110 and 110*a* until the center drill floor section 140 is in position as shown in FIGS. 18 and 18*a*. To facilitate the "skidding" of the center drill floor 140 into position, the leading edges of the support rails 180 and 180*a* (i.e., the edges of the support rails on the drawworks side of the rig that first come into contact with the center drill floor section 140 as it is skidded into position) may have rounded ends that taper slightly downward. Similarly, the leading edges of the support rails 200 and 200*a* attached to the center drill floor section 140 (i.e., the edges of the support rails on the V-door side of the center drill floor section 140 that first come into contact with the drill floor side boxes 110 and 110*a* as the center drill floor section is skidded into position) may also be rounded to facilitate the skidding of the center drill floor section 140 onto the support rails 180 and 180*a*. Additionally, if the height of trailer 146 is such that the center drill floor section 140 (mounted on trailer 146 as shown in FIG. 18) is higher than the drill floor side boxes 110 and 110*a* when in position for connection, the drill floor side boxes 110 and 110*a* can be slightly raised through the use of drill floor raising cylinders 126 and 126*a* to roughly align the height of the drill floor side boxes 110 and 110*a* with the center drill floor section 140 prior to skidding the center drill floor section 140 into position.

For horizontal guiding of the center drill floor section 140 onto the support rails 180 and 180*a*, a unique guide bar system that allows the center drill floor section 140 to be guided into place for connection to the drill floor side boxes 110 and 110*a* is utilized The guide bar system employs multiple mating blocks attached to support rails 180 and 180*a* on drill floor side boxes 110 and 110*a* and attached to support rails 200 and 200*a* on center drill floor section 140. These mating blocks are positioned on support rails 180 and 180*a* and support rails 200 and 200*a* to create structural connection points along the support rails that get progressively "tighter" as the center drill floor section 140 is pulled further onto the drill floor side boxes 110 and 110*a*. In essence, the guide bar system acts as a funnel that forces the center drill floor section 140 into horizontal alignment between the drill floor side boxes 110 and 110*a* as the center drill floor section 140 is progressively pulled into position—i.e., as the center drill floor section 140 is pulled from the drawworks side of the rig toward the V-door side of the rig as shown in FIG. 18*a*. When the center drill floor section 140 is completely pulled onto support rails 180 and 180*a*, the "connection" between the mating blocks on support rails 180 and 180*a* and the corresponding mating blocks on support rails 200 and 200*a* is tight enough to serve as a structural connection and will prevent the substructure from vibrating or moving when the rig is raised and in operation.

The guide bar system according to one embodiment of the present invention is shown in more detail in FIGS. 19-20. As shown in FIG. 19, the surfaces (B) of support rails 200 and 200*a* on the center drill floor section 140 skid on surfaces (A) of the support rails 180 and 180*a* attached to the drill floor side boxes 110 and 110*a*. In one embodiment of the present invention, there are four mating blocks attached to both support rails 180 and 180*a* (for a total of eight mating blocks on the drill floor side boxes 110 and 110*a*), and four corresponding mating blocks attached to both support rails 200 and 200*a* (for a total of eight mating blocks on the center drill floor section 140). The leading edge mating blocks 208 and 208*a* attached to support rails 200 and 200*a* and the corresponding mating blocks 188 and 188*a* attached to support rails 180 and 180*a* are shown in FIG. 19. Although the guide bar system discussed with reference to FIGS. 19-20 discloses four mating blocks per support bar, one of skill in the are will appreciate that the number of mating blocks used in the guide bar system may vary depending on a number of factors, including, but not limited to, the length of the drill floor side boxes and center drill floor, the width of the drill floor, the weight of the drill floor, and the expected horizontal loads that may act on the drill floor.

The mating blocks shown in FIGS. 19-20 consist of short lengths of metal "bar" approximately 12 inches long in the preferred embodiment. One of skill in the art will appreciate that the size of the mating blocks used in the guide bar system may vary depending on a number of factors, including, but not limited to, the length of the drill floor side boxes and center drill floor, the width of the drill floor, the weight of the drill floor, and the expected horizontal loads that may act on the drill floor.

In a preferred embodiment, flat guide bar 210 runs along a diagonal line between and connecting the four mating blocks of each support bar 180 and 180*a*. Flat guide bar 210 helps guide the mating blocks on support rails 200 and 200*a* of the center drill floor section 140 into "mating" position with the mating blocks on the support rails 180 and 180*a* on the drill floor side boxes 110 and 110*a*. Specifically, as shown in detail in FIG. 20 with respect to support bar 180 on drill floor side box 110, the leading edge mating block 182 (i.e., the mating block on support bar 180 closest to the drawworks side of the drilling rig) is attached to support bar 180 at a location close to the drill floor side box 110. The second mating block 184 on support bar 180 (i.e., the first mating block after the leading edge mating block 182 in the direction of the V-door side) is attached to support bar 180 at a location slightly further from the drill floor side box 110 then the leading edge mating block 182. In a similar fashion, the third and fourth mating blocks 186 and 188 are attached to support bar 180 at locations slightly further from the drill floor side box 110 than the preceding mating blocks.

Corresponding mating blocks 202, 204, 206 and 208 are attached to support bar 200 on the center drill floor section 140 as shown in FIG. 20. The leading edge mating block 208 of the center drill floor section 140 (i.e., the mating block that is closest to the V-door side of the rig when the center drill floor section is completely pulled into position) is attached to support bar 200 close to the center drill floor section 140. The second mating block 206 (i.e., the first mating block after the leading edge mating block 208 in the direction of the drawworks side) is attached to support bar 200 at a location slightly further from the center drill floor section 140 then the leading edge mating block 208. In a similar fashion, the third and fourth mating blocks 204 and 202 are attached on support bar 200 at locations slightly further from the center drill floor section 140 than the preceding mating blocks.

In this way, the space between leading edge mating blocks 182 and 182*a* and 208 and 208*a* as the center drill floor section 140 is skidded onto support rails 180 and 180*a* is wide enough such that the alignment of the center drill floor section 140 with the drill floor side boxes 110 and 110*a* does not have to be precise. As the center drill floor section 140 is pulled onto support rails 180 and 180*a* (in the direction toward the V-door side of the drilling rig), leading edge mating blocks 208 and 208*a* on support rails 200 and 200*a* will contact and slide against guide bar 210. In a similar fashion, mating blocks 206 and 206*a*, 204 and 204*a*, and 202 and 202*a* on support rails 200 and 200*a* will contact and slide against guide bar 210 as the center drill floor section 140 is pulled progressively further onto support rails 180 and 180*a*.

The guide bar 210 serves to align the support rails 180 and 180*a* on drill floor side boxes 110 and 110*a* and the support rails 200 and 200*a* on center drill floor section 140 in an "overlapping" manner such that the vertical load created by the weight of the center drill floor section 140 is distributed over and carried by the entire surfaces of support rails 180 and 180*a*. The diagonal direction of the guide bar 210 acts as the "funnel" that forces the mating blocks attached to support rails 200 and 200*a* inwardly such that the space between the mating blocks gets progressively smaller as each successive mating block on support rails 200 and 200*a* is pulled into position.

Ultimately, when center drill floor section 140 has been completely skidded into position, mating blocks 182 and 182*a* on support rails 180 and 180*a* are in "mating" position with mating blocks 202 and 202*a* on support rails 200 and 200*a*. Similarly, mating blocks 184 and 184*a*, 186 and 186*a*, and 188 and 188*a* on support rails 180 and 180*a* are "mated" with mating blocks 204 and 204*a*, 206 and 206*a*, and 208 and 208*a* respectively on support rails 200 and 200*a* as shown in FIG. 20. In the "mating" position, the "gap" between the mating blocks in the preferred embodiment is only approximately 1/16 in. The following measurement is given by way of example only. One of skill in the art will recognize that the size of this gap may be increased or decreased while still achieving the objectives of the present invention.

The mating blocks form a structural connection point and transfer horizontal loads between the center drill floor section 140 and the drill floor side boxes 110 and 110*a*. The horizontal load handling capability of the mating blocks when "connected" (i.e., when in the "mated" position) is a significant feature that allows the connection points created by the mating blocks to resist side loads that create moment forces. The moment carrying ability of the mating blocks is augmented through the use of pin connections at each site where the mating blocks mate. Thus, if four mating blocks are used on each support bar 180 and 180*a*, there will be four corresponding pin connections along each support bar 180 and 180*a*.

The mating blocks and pin connections are positioned on the support rails 180 and 180*a* at locations where the main spreader assemblies of the drill floor are located. These locations are shown in FIG. 18*a* as connection points 134-137 and 134*a*-137*a*. As can be seen in FIG. 19 with respect to connection point 137 and 137*a*, pin lugs 220 and 220*a* are attached to the drill floor side boxes 110 and 110*a*. Pin lugs 220 and 220*a* have arms 222 and 222*a* attached thereto that contain pin holes 224 and 224*a*. To form the pin connection between the center drill floor section 140 and the drill floor side boxes 110 and 110*a*, arms 222 and 222*a* can rotate upward such that pin holes 224 and 224*a* are aligned with pin holes 242 and 242*a* on pin lugs 240 and 240*a* attached to the center drill floor section 140. Pins are then driven through the aligned pin holes 224 and 242 and pin holes 224*a* and 242*a*. In a similar fashion, additional pin connections of the type described are made at connection points 134-136 and 134*a*-136*a*, and the center drill floor section 140 is secured in place.

In the preferred embodiment, the guide bar 210 and mating blocks 182, 182*a*, 184, 184*a*, 186, 186*a*, 188, 188*a*, 202, 202*a*, 204, 204*a*, 206, 206*a*, 208, and 208*a* are welded to support rails 180, 180*a* and 200, 200*a*. One of skill in the art will appreciate that the guide bar and mating blocks can be attached to the support rails by any suitable metal-to-metal connection method capable of handling the forces and stresses imposed on the guide bar and mating blocks.

In an alternative embodiment of the present invention, support rails 180 and 180*a* may have two mating blocks separated by a small distance attached at each connection point along support rails 180 and 180*a*. The distance between the mating blocks is such that the corresponding mating blocks attached to support rails 200 and 200*a* fit securely in the gap between the two mating blocks attached to support rails 180 and 180*a* when the center drill floor section 140 has been completely skidded into position. In this way, a three-block structural connection is achieved—with the single mating blocks attached to support rails 200 and 200*a* "sandwiched" between the corresponding two mating blocks on support rails 180 and 180*a*.

Similarly, in another alternative embodiment of the present invention, the position of the two mating blocks and the single mating blocks in the three-block structural connection described in the preceding paragraph can be reversed, i.e., support rails 200 and 200*a* may have two mating blocks separated by a small distance attached at each connection point along the rails, the distance between the two mating blocks being sized such that the corresponding mating blocks attached to support rails 180 and 180*a* fit securely in the gap between the two mating blocks attached to support rails 200 and 200*a* when the center drill floor section 140 has been completely skidded into position. The result is a three-block structural connection in which the single mating blocks attached to support rails 180 and 180*a* are "sandwiched" between the corresponding two mating blocks on support rails 200 and 200*a*.

While the apparatus, compositions and methods of this invention have been described in terms of preferred or illustrative embodiments, it will be apparent to those of skill in the art that variations may be applied to the process described herein without departing from the concept and scope of the invention. All such similar substitutes and modifications apparent to those skilled in the art are deemed to be within the scope and concept of the invention as it is set out in the following claims.

What is claimed is:

1. A transportable drilling rig comprising:

a first side box comprising one or more positioning pads and one or more leg frames, wherein each positioning pad comprises a plurality of positioning cylinders capable of moving the side box in the horizontal and vertical directions;

a second side box comprising one or more positioning pads and one or more leg frames, wherein each positioning pad comprises a plurality of positioning cylinders capable of moving the side box in the horizontal and vertical directions;

a drill floor connected to the first and second side boxes; and a drilling rig mast connected to the drill floor.

2. The transportable drilling rig of claim 1 wherein the first side box and the second side box further comprise one or more telescoping diagonal braces, the one or more telescoping diagonal braces being designed to secure the drill floor in an elevated position.

3. The transportable drilling rig of claim 2 wherein the one or more telescoping diagonal braces comprise concentric cylinders and wherein the one or more telescoping diagonal braces are in an extended position prior to the drill floor being raised to the elevated position such that the concentric cylinders telescope inwardly as the drill floor is raised.

4. The transportable drilling rig of claim 3 further comprising one or more drill floor raising cylinders, wherein the one or more drill floor raising cylinders are hydraulically actuated for raising the drill floor to the elevated position.

5. The transportable drilling rig of claim 4 further comprising one or more mast raising cylinders, wherein the one or more mast raising cylinders are hydraulically actuated for raising the drilling rig mast.

6. The transportable drilling rig of claim 1 wherein the first side box and the second side box each have a fifth-wheel connection for connection to a truck and wherein the first side box and the second side box are each connected to a wheeled transporter for transporting the first side box and the second side box by truck.

7. The transportable drilling rig of claim 1 wherein the plurality of positioning cylinders are hydraulic.

8. A transportable drilling rig comprising:

a first side box comprising a base side box, a drill floor side box, one or more telescoping diagonal braces, and one or more leg frames, wherein the one or more leg frames support the drill floor side box in an elevated position;

a second side box comprising a base side box, a drill floor side box, one or more telescoping diagonal braces, and one or more leg frames, wherein the one or more leg frames support the drill floor side box in the elevated position;

a drill floor comprising a center drill floor section connected to the drill floor side boxes of the first side box and the second side box;

one or more drill floor raising cylinders for raising the drill floor to the elevated position;

wherein the one or more telescoping diagonal braces of the first and second side boxes comprise concentric cylinders and wherein the one or more telescoping diagonal braces are in an extended position prior to the drill floor being raised to the elevated position such that the concentric cylinders telescope inwardly as the drill floor is raised and the one or more telescoping diagonal braces secure the drill floor in the elevated position;

a drilling rig mast connected to the drill floor; and one or more mast raising cylinders connected to the drilling rig mast.

9. The transportable drilling rig of claim 8 wherein the first and second side boxes further comprise one or more positioning pads, each positioning pad having a plurality of positioning cylinders capable of moving the first and second side boxes in the horizontal and vertical directions.

10. The transportable drilling rig of claim 9 wherein the plurality of positioning cylinders are operated by a portable hydraulic power unit and wherein the plurality of positioning cylinders are used to align connection points on the drill floor side boxes with connection points on the center drill floor section.

11. The transportable drilling rig of claim 8 wherein the one or more drill floor raising cylinders and the one or more mast raising cylinders are hydraulically actuated.

12. The transportable drilling rig of claim 8 wherein the first side box and the second side box each have a fifth-wheel connection for connection to a truck and wherein the first side box and the second side box are each connected to a wheeled transporter for transporting the first side box and the second side box by truck.

13. The transportable drilling rig of claim 8 wherein the drilling rig mast comprising comprises a bottom section, a lower section, and a top section.

14. The transportable drilling rig of claim 13 wherein:

the top section of the drilling rig mast is connected to a truck by a fifth-wheel connection, the fifth-wheel connection having a plurality of positioning cylinders capable of moving the top section of the drilling rig mast in the horizontal and vertical directions;

the top section of the drilling rig mast is also connected to a positioning dolly for transport to a drill site, the positioning dolly having a plurality of positioning cylinders capable of moving the top section of the drilling rig mast in the horizontal and vertical directions; and the lower section of the drilling rig mast is transportable by a wheeled trailer.

15. A method of assembling a drilling rig at a drill site comprising:

positioning a first side box, the first side box comprising one or more positioning pads connected thereto;

positioning a center drill floor section;

aligning a plurality of connection points on the center drill floor section with a plurality of connection points on the first side box through operation of the positioning pads connected to the first side box;

connecting the center drill floor section to the first side box;

positioning a second side box, the second side box comprising one or more positioning pads connected thereto;

aligning a plurality of connection points on the center drill floor section with a plurality of connection points on the second side box through operation of the positioning pads connected to the second side box;

connecting the center drill floor section to the second side box;

connecting a drilling rig mast to the center drill floor section, the drilling rig mast comprising one or more mast sections;

raising the drilling rig mast; and raising a drill floor to an elevated position, the drill floor comprising the drill floor side boxes connected to the center drill floor section.

16. The method of claim 15 further comprising utilizing a plurality of positioning cylinders integral to the positioning pads of the first and second side boxes to move the first and second side boxes in the horizontal and vertical directions for alignment of the first and second side boxes with the center drill floor section for connection thereto.

17. The method of claim 16 further comprising connecting the center drill floor section to the first and second side boxes by pinning a plurality of mating lugs attached to the first and second side boxes together with a plurality of mating lugs attached to the center drill floor section.

18. The method of claim 15 further comprising connecting two or more mast sections of the drilling rig mast together to form the drilling rig mast prior to connecting the drilling rig mast to the center drill floor section.

19. The method of claim 18 wherein the drilling rig mast is raised by one or more mast raising cylinders.

20. The method of claim 19 further comprising supporting the drill floor in the elevated position with a plurality of leg frames.

21. The method of claim 20 further comprising securing the drill floor in the elevated position with a telescoping diagonal brace.

22. The method of claim 21 whereby the one or more telescoping diagonal braces telescope inwardly to a retracted position as the drill floor is raised to the elevated position.

23. The method of claim 22 further comprising retaining the one or more telescoping diagonal braces in the retracted position by pinning the one or more telescoping diagonal braces to the lower portion of the first and second side boxes.

24. A method of assembling a drilling rig at a drill site comprising:

positioning a first side box, the first side box comprising a base side box, a drill floor side box, one or more telescoping diagonal braces, and one or more leg frames;

positioning a center drill floor section;

connecting the center drill floor section to the first side box;

positioning a second side box, the second side box comprising a base side box, a drill floor side box, one or more telescoping diagonal braces, and one or more leg frames;

connecting the center drill floor section to the second side box;

connecting a drilling rig mast to the center drill floor section, the drilling rig mast comprising one or more mast sections;

raising the drilling rig mast;

raising a drill floor to an elevated position, the drill floor comprising the drill floor side boxes connected to the center drill floor section;

supporting the drill floor in the elevated position with the one or more leg frames of the first and second side boxes; and securing the drill floor in the elevated position with the one or more telescoping diagonal braces of the first and second side boxes, whereby the one or more telescoping diagonal braces telescope inwardly to a retracted position as the drill floor is raised to the elevated position.

25. A method as defined in claim 24, wherein:

a section of the drilling rig mast is transported to the drill site with a top drive installed prior to transport to the drill site;

a section of the drilling rig mast is transported to the drill site with a drill line spooler installed prior to transport to the drill site, the drill line spooler having drill line is spooled around the drill line spooler prior to transport to the drill site;

a section of the drilling rig mast is transported to the drill site with a traveling block installed prior to transport to the drill site; and the top section of the drilling rig mast is transported to the drill site with a crown block installed prior to transport to the drill site.

26. A method as defined in claim 24, wherein a top or lower section of the drilling rig mast is connected to a truck by a fifth-wheel connection for transport to the drill site, the fifth-wheel connection having a plurality of positioning cylinders capable of moving the top or lower section of the drilling rig mast in the horizontal and vertical directions.

* * * * *

UNITED STATES PATENT AND TRADEMARK OFFICE

CERTIFICATE OF CORRECTION

PATENT NO. : 7,765,749 B2
APPLICATION NO. : 10/827956
DATED : August 3, 2010
INVENTOR(S) : Palidis It is certified that error appears in the above-identified patent and that said Letters Patent is hereby corrected as shown below:

Column 18, Line 62: after "mast" remove --comprising--

Signed and Sealed this

Ninth Day of November, 2010

David J. Kappos

David J. Kappos
*Director of the United States Patent and Trademark Office*